US008503908B2

(12) United States Patent
Kuroda

(10) Patent No.: US 8,503,908 B2
(45) Date of Patent: Aug. 6, 2013

(54) IMAGE FORMING APPARATUS

(75) Inventor: Mitsuaki Kuroda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 292 days.

(21) Appl. No.: 12/976,064

(22) Filed: Dec. 22, 2010

(65) Prior Publication Data

US 2011/0318066 A1 Dec. 29, 2011

(30) Foreign Application Priority Data

Jun. 25, 2010 (JP) ..... P2010-144543

(51) Int. Cl.
*G03G 15/02* (2006.01)
*G03G 15/00* (2006.01)

(52) U.S. Cl.
USPC ..... 399/117; 399/167

(58) Field of Classification Search
USPC ..... 74/572.21, 572.13, 572, 2, 433.5, 74/574.4; 399/302, 117, 167
See application file for complete search history.

(56) References Cited

U.S. PATENT DOCUMENTS 5,154,097 A * 10/1992 Barthruff et al. ..... 74/574.4
6,131,486 A * 10/2000 Doman ..... 74/572.21
6,546,689 B1 * 4/2003 Kim ..... 52/698

FOREIGN PATENT DOCUMENTS

JP 08270642 A * 10/1996
JP 2001188438 A * 7/2001
JP 2002005237 A * 1/2002
JP 2004-278572 10/2004

OTHER PUBLICATIONS

Machine translations of Kawai et al., Kato, and Makino et al.*

* cited by examiner

*Primary Examiner* — David Gray
*Assistant Examiner* — Sevan A Aydin
(74) *Attorney, Agent, or Firm* — Sughrue Mion, PLLC

(57) ABSTRACT

An image forming apparatus comprising: a rotary body which rotates in accordance with an image forming operation; a rotation shaft of the rotary body; a through hole which is provided in an end portion in an axial direction of the rotation shaft; a stabilizing member which is provided to rotate together with the rotary body and stabilize the rotary body by reducing fluctuations of rotation of the rotary body under inertia, and which has an inserted portion into which the rotation shaft is inserted; a holding member which is disposed so as to be adjacent to the stabilizing member in the axial direction to hold the stabilizing member on the rotation shaft; a through hole which is formed in the longitudinal portion correspondingly to the through hole provided in the rotation shaft; and a clamp member which passes through the through hole provided in the longitudinal portion and the through hole provided in the rotation shaft.

8 Claims, 14 Drawing Sheets

Fig. 10A
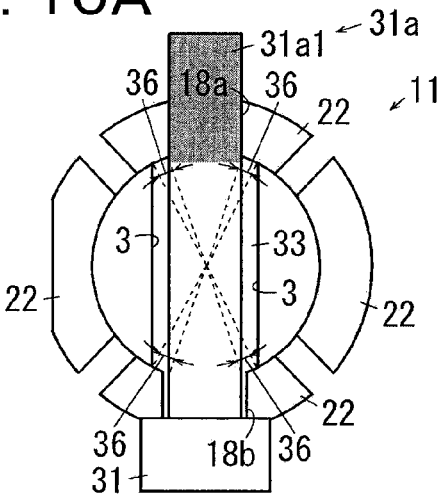
Fig. 10D
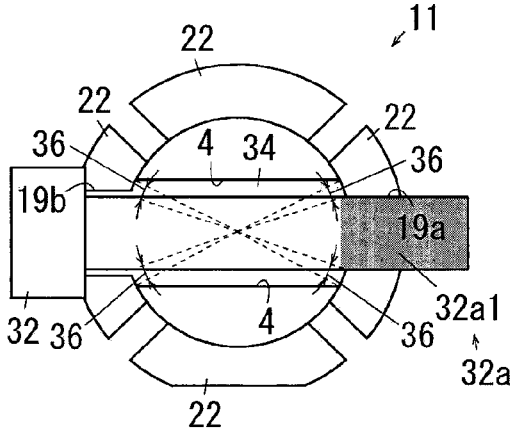
Fig. 10B
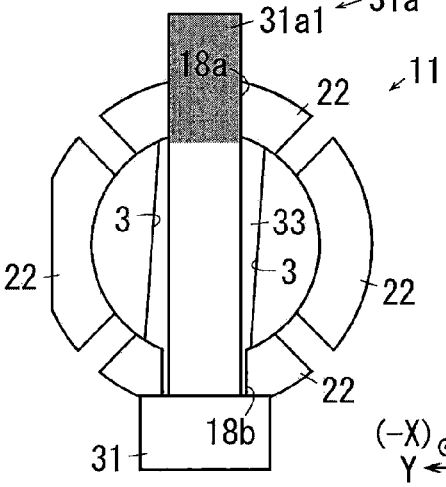
Fig. 10E
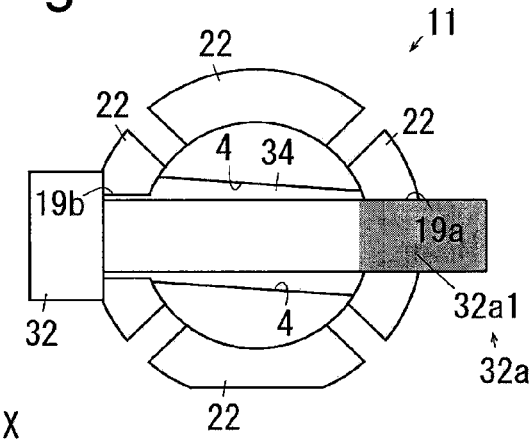
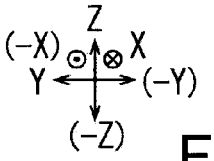
Fig. 10C
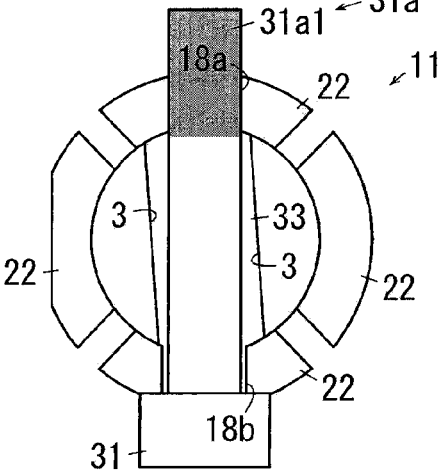
Fig. 10F
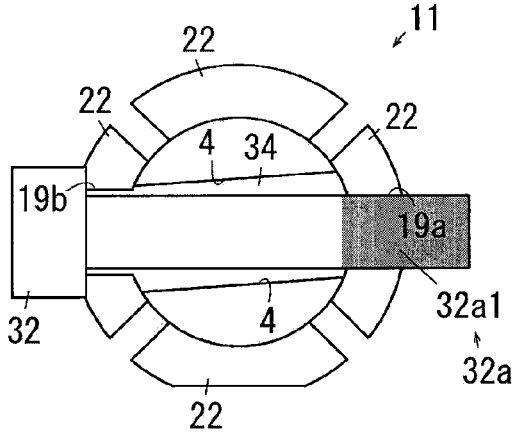

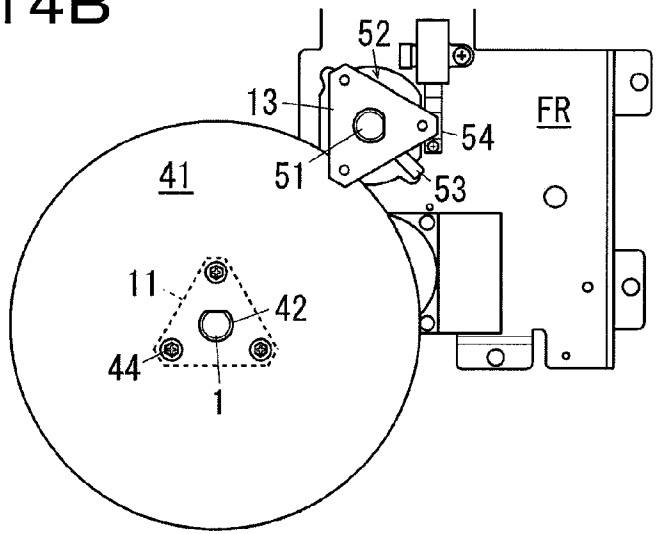
Fig. 14B
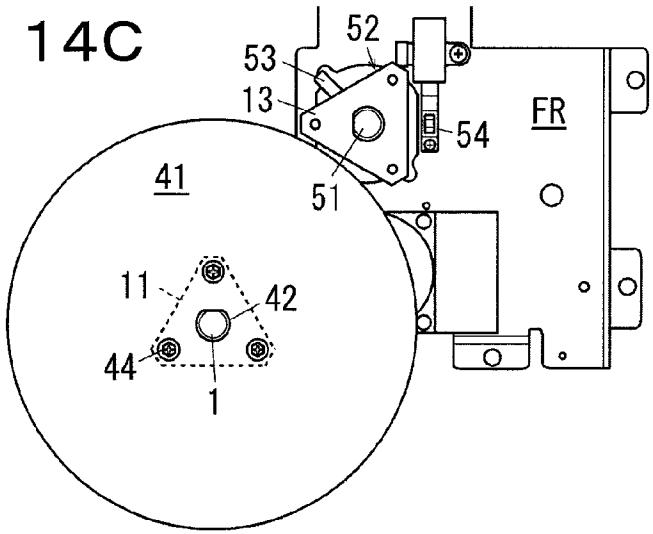
Fig. 14C
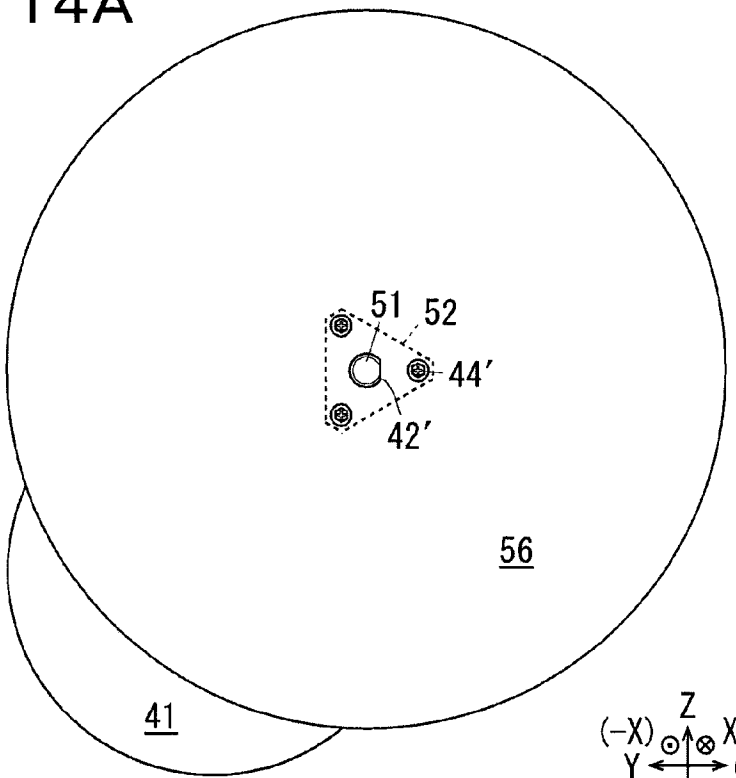
Fig. 14A
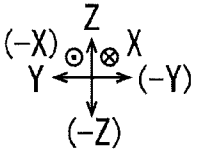

IMAGE FORMING APPARATUS

CROSS-REFERENCE TO RELATED APPLICATION

This application is based on and claims priority under 35 USC 119 from Japanese Patent Application No. 2010-144543 filed on Jun. 25, 2010.

BACKGROUND

Technical Field

The present invention relates to an image forming apparatus.

SUMMARY

According to an aspect of the invention, an image forming apparatus comprising:

a rotary body which rotates in accordance with an image forming operation;

a rotation shaft of the rotary body;

a through hole which is provided in an end portion in an axial direction of the rotation shaft and which passes through the rotation shaft in a direction intersecting the axial direction of the rotation shaft;

a stabilizing member which is provided to rotate together with the rotary body and stabilize the rotary body by reducing fluctuations of rotation of the rotary body under inertia, and which has an inserted portion into which the rotation shaft is inserted;

a holding member which is disposed so as to be adjacent to the stabilizing member in the axial direction to hold the stabilizing member on the rotation shaft, and which has a longitudinal portion having the rotation shaft inserted therein, and a support portion provided in an end portion of the longitudinal portion in the axial direction to support the stabilizing member;

a clamp member which tightens the longitudinal portion onto the rotation shaft to bring an inner wall of the longitudinal portion into tight contact with the rotation shaft, wherein the through hole of the rotation shaft and the clamp member have a clearance in an entire circumference of the clamp member therebetween.

BRIEF DESCRIPTION OF THE DRAWINGS

Exemplary embodiments of the invention will be described in detail based on the following figures, wherein:

FIG. 3A is an explanatory view of the belt module and the photoconductor drum when seen from the right, and FIG. 3B is an explanatory view of a belt driving roll and a belt driving shaft, FIG. 4A is an explanatory view of a rear end portion of the belt driving shaft, FIG. 4B is a sectional view taken along the line IVB-IVB in FIG. 4A, FIG. 4C is a sectional view taken along the line IVC-IVC in FIG. 4A and FIG. 4D is a sectional view taken along the line IVD-IVD in FIG. 4A, FIGS. 5A and 5B are explanatory views showing the belt driving shaft and a holder according to exemplary embodiment 1 of the invention, specifically FIG. 6A is a perspective view when seen from a lower right front side, and FIG. 6B is a perspective view when seen from a lower right rear side, FIG. 7A is an explanatory view when seen from the front, FIG. 7B is an explanatory view when seen from the rear, FIG. 7C is an explanatory view from a direction of an arrow VIIC in FIG. 7A, FIG. 7D is an explanatory view from a direction of an arrow VIID in FIG. 7A, and FIG. 7E is an explanatory view from a direction of an arrow VIIE in FIG. 7A, FIGS. 8A to 8C are explanatory views showing a D cut portion and a receiving hole according to exemplary embodiment 1 of the invention, specifically FIG. 9A is an enlarged view of important part in FIG. 3A, and FIG. 9B is a sectional view of the rear rend portion of the belt driving shaft in FIG. 9A, FIGS. 10A to 10F are explanatory views showing a screw pass-through hole and a clamp screw due to relative rotation between the belt driving shaft and the holder according to exemplary embodiment 1 of the invention, specifically FIG. 10A is an explanatory view corresponding to FIG. 8A about a rear screw pass-through hole and a rear clamp screw, FIG. 10B is an explanatory view corresponding to FIG. 8B about the rear screw pass-through hole and the rear clamp screw, FIG. 10C is an explanatory view corresponding to FIG. 8C about the rear screw pass-through hole and the rear clamp screw, FIG. 10D is an explanatory view corresponding to FIG. 8A about a front screw pass-through hole and a front clamp screw, FIG. 10E is an explanatory view corresponding to FIG. 8B about the front screw pass-through hole and the front clamp screw, and FIG. 10F is an explanatory view corresponding to FIG. 8C about the front screw pass-through hole and the front clamp screw, FIG. 12 is a perspective view of the drum driving shaft according exemplary embodiment 1 of the invention when seen from a rear end direction, while illustration of the flywheel for the drum driving shaft is omitted, FIGS. 14A to 14C are explanatory views showing a method for removing a flywheel according to exemplary embodiment 1 of the invention, specifically FIG. 14A is an explanatory view of a state where two flywheels have been mounted, FIG. 14B is an explanatory view of a state where one of the flywheels has been removed, and FIG. 14C is an explanatory view immediately before the other flywheel is removed.

DETAILED DESCRIPTION

Figure 1:
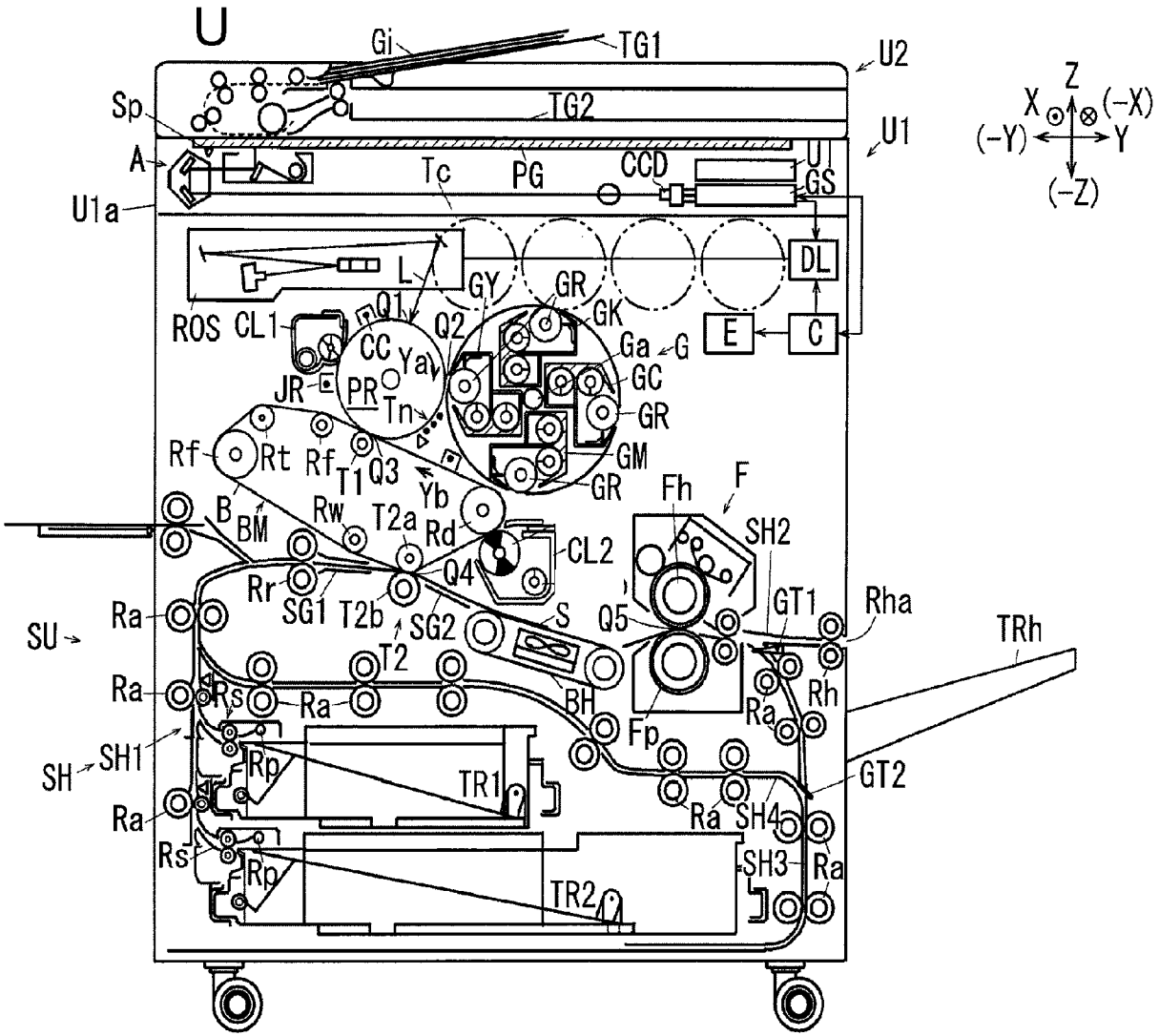
FIG. 1 is an overall explanatory view of an image forming apparatus according to exemplary embodiment 1 of the invention.

Although a specific example of a mode for carrying out the invention (hereinafter referred to as "exemplary embodiment") will be described below with reference to the drawings, the invention is not limited to the following exemplary embodiment.

In order to facilitate understanding of the following description, in the drawings, the front-rear direction is indicated as an X-axis direction, the left-right direction is indicated as a Y-axis direction and the up-down direction is indicated as a Z-axis direction, and directions or sides designated by the arrows X, −X, Y, −Y, Z and −Z are indicated as a front direction, a rear direction, a right direction, a left direction, an upper direction and a lower direction, or a front side, a rear side, a right side, a left side, an upper side and a lower side, respectively.

In the drawings, each arrow with "•" written in "○" is an arrow directed from the back side of the sheet to the front side thereof and each arrow with "x" written in "○" is an arrow directed from the front side of the sheet to the back side thereof.

In the following description using the drawings, any other member than members required for description is omitted from the drawings suitably for the purpose of facilitating understanding.

[Exemplary Embodiment 1]

FIG. 1 is an overall explanatory view of an image forming apparatus according to exemplary embodiment 1 of the invention.

In FIG. 1, the image forming apparatus U according to exemplary embodiment 1 is formed of a copying machine. The image forming apparatus U has an image forming apparatus body U1, and an automatic document feeder U2. The image forming apparatus body U1 has a platen glass PG as an example of a transparent document reading surface provided at a top end of the image forming apparatus body U1. The automatic document feeder U2 is disposed on the platen glass PG of the image forming apparatus body U1. The automatic document feeder U2 has a document feed tray TG1 as an example of a document feed portion on which plural of documents G1 to be copied are stacked. The plurality of documents G1 stacked on the document feed tray TG1 are successively conveyed to a predetermined document reading position on the platen glass PG, and ejected onto a document ejection tray TG2 as an example of a document ejection portion. A rear end portion of the automatic document feeder U2 is supported by an open/close shaft so that the automatic document feeder U2 may be rotated relative to the image forming apparatus body U1. The open/close shaft is not shown but extends in the left-right direction. The automatic document feeder U2 is rotated upward when such documents G1 will be placed on the platen glass PG.

The image forming apparatus body U1 has a user interface UI as an example of an operation portion on which a user performs an operation for entering an operation instruction signal.

A scanner portion U1*a* as an example of a document reader is disposed below the platen glass PG located as the top surface of the image forming apparatus body U1. The scanner portion U1*a* has an exposure-system registration sensor Sp as an example of an exposure-system detection member, and an exposure optical system A. The exposure-system registration sensor Sp is disposed in a platen registration position which is an example of an exposure reference position. The movement and stop of the exposure optical system A are controlled in accordance with a signal detected by the exposure-system registration sensor Sp. Ordinarily, the exposure optical system A is stopped at a home position which is an example of an initial position. Reflected light from a document G1 which is sent by the automatic document feeder U2 and passes through the document reading position on the top surface of the platen glass PG or reflected light from a document G1 manually placed on the platen glass PG is converted into R (Red), G (Green) and B (Blue) electric signals by a solid-state image sensor CCD through the exposure optical system A. The RGB electric signals are inputted to an image processing portion GS.

The image processing portion GS converts the RGB electric signals inputted from the solid-state image sensor CCS into image data as an example of K (Black), Y (Yellow), M (Magenta) and C (Cyan) image information, temporarily stores the image data, and outputs the image data as latent image-forming image data to a laser driving circuit DL at a predetermined time. The laser driving circuit DL is an example of a latent image-forming driving circuit. The laser driving circuit DL outputs a driving signal to a latent image forming device ROS in accordance with the inputted image data.

Figure 2:
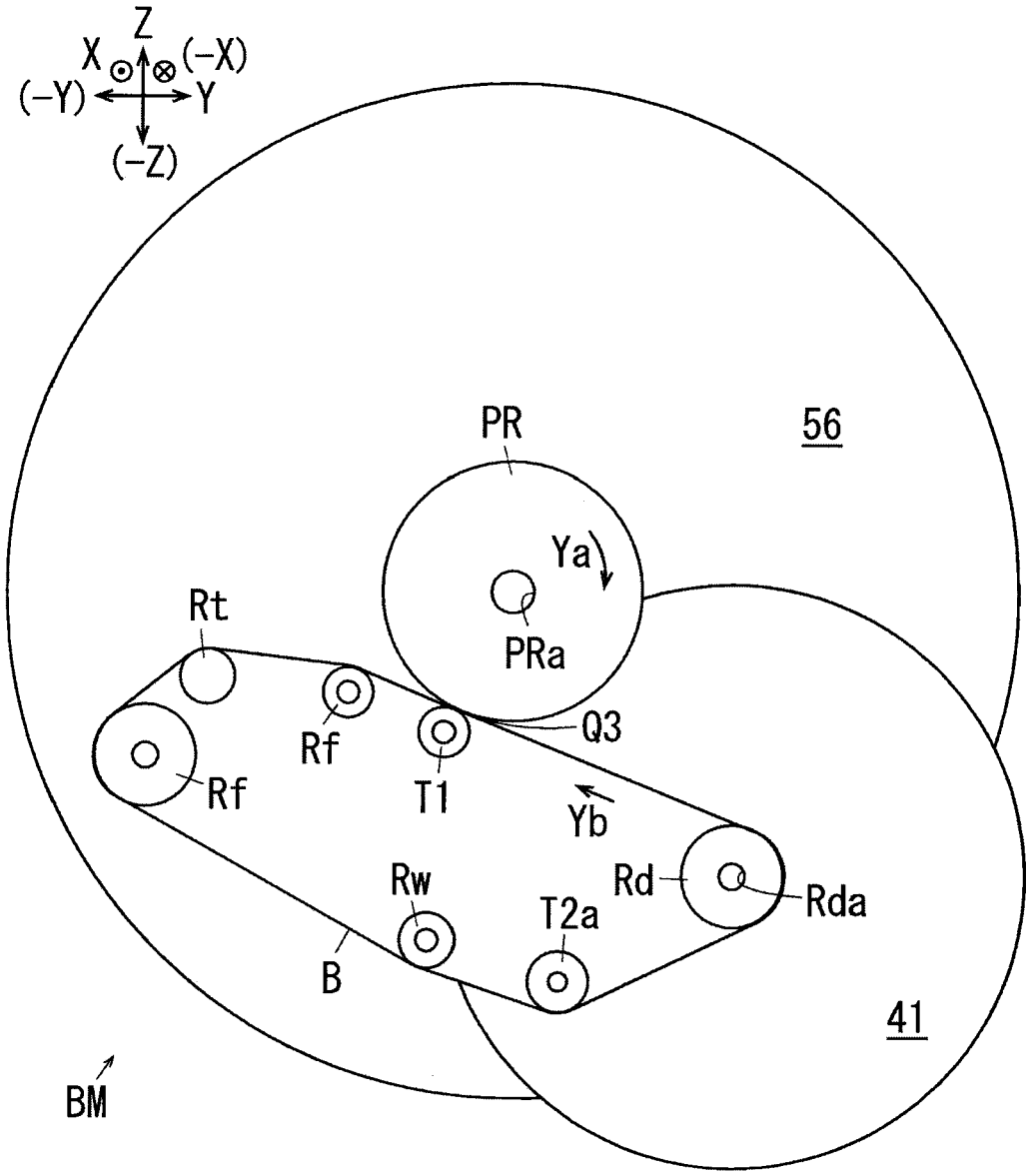
FIG. 2 is an enlarged view of important part of the image forming apparatus according to exemplary embodiment 1 of the invention, specifically an enlarged view of important view concerned with a photoconductor drum and a belt module.

FIG. 2 is an enlarged view of important part of the image forming apparatus according to exemplary embodiment 1 of the invention. Specifically, FIG. 2 is an enlarged view of important part concerned with a photoconductor drum and a belt module.

In FIGS. 1 and 2, the photoconductor drum PR as an example of an image retainer and also as an example of a first rotary body rotates in a direction of an arrow Ya. After the surface of the photoconductor drum PR is destaticized by a destaticizer JR and uniformly electrostatically charged by a charger CC, the surface of the photoconductor drum PR is scanned by exposure to a laser beam L as an example of latent image writing light from the latent image forming device ROS in a latent image writing position Q1 so that an electrostatic latent image is formed on the surface of the photoconductor drum PR. For formation of a color image as an example of a multi-color image, electrostatic latent images corresponding to images of four colors K (black), Y (yellow), M (magenta) and C (cyan) are formed successively on the surface of the photoconductor drum PR. For formation of a monochromatic image as an example of a mono-color image, only an electrostatic latent image corresponding to a K (black) image is formed on the surface of the photoconductor drum PR.

In FIG. 1, the surface of the photoconductor drum PR having the electrostatic latent image or images formed thereon rotates so as to pass through a developing region Q2 and a primary transfer region Q3 successively.

A rotary type developing device G as an example of a rotation type developing device is disposed in the right of the photoconductor drum PR so as to face the photoconductor drum PR at the developing region Q2. The developing device G has four developing units GK, GY, GM, and GC of four colors K (black), Y (yellow), M (magenta) and C (cyan). The developing units GK, GY, GM, and GC rotate and move successively to the developing region Q2 in accordance with rotation of a developing rotation shaft Ga of the developing device G. Each of the developing units GK, GY, GM, and GC has a developing roll GR as an example of a developing agent retainer for conveying a developing agent to the developing region Q2. An electrostatic latent image on the photoconductor drum PR passing through the developing region Q2 is developed into a toner image Tn as an example of a visible image by each developing unit. Configuration is made in such a manner that a new developing agent is supplied to each of the developing units GK, GY, GM, and GC from a toner cartridge Tc as an example of a developing agent container.

In FIGS. 1 and 2, the belt module BM as an example of an intermediate transfer device is disposed under the photoconductor drum PR. The belt module BM has an intermediate transfer belt B as an example of an intermediate transferer and also as an example of a second rotary body. The intermediate transfer belt B is disposed so as to face the photoconductor drum PR at the primary transfer region Q3. The intermediate transfer belt B is supported by belt supporting rolls (Rd, Rt, Rw, Rf and T2a) as an example of intermediate transferer supporting members and a primary transfer roll T1 as an example of a primary transfer member so that the intermediate transfer belt B may rotate in the direction Yb. The belt supporting rolls (Rd, Rt, Rw, Rf and T2 *a*) include a belt driving roll Rd as an example of an intermediate transferer driving member, a tension roll Rt as an example of an intermediate transferer straining member, a walking roll Rw as an example of a meander preventing member, an idler roll Rf as an example of an intermediate transferer driven member, and a backup roll T2a as an example of a secondary transfer facing member.

The intermediate transfer belt B, the belt driving roll Rd, the tension roll Rt, the walking roll Rw, the idler roll Rf, the backup roll T2*a* and the primary transfer roll T1 form the belt module BM according to exemplary embodiment 1.

For formation of a color image, an electrostatic latent image of a first color is formed at the latent image writing position Ql, and a toner image Tn of the first color is formed at the developing region Q2. The toner image Tn is primarily transferred onto the intermediate transfer belt B by the primary transfer roll T1 when the toner image Tn passes through the primary transfer region Q3. Then, in the same manner as described above, toner images Tn of second, third and fourth colors are primarily transferred successively onto the intermediate transfer belt B on which the toner image Tn of the first color has been already transferred. Finally, a multi-color toner image is formed on the intermediate transfer belt B. For formation of a monochromatic image, only the black developing unit GK is used so that a mono-color toner image is primarily transferred onto the intermediate transfer belt B. After the primary transfer, the surface of the photoconductor drum PR is destaticized by the destaticizer JR and cleaned by a photoconductor cleaner CL1 as an example of an image retainer cleaning unit.

In FIG. 1, a secondary transfer roll T2*b* as an example of a secondary transfer member is disposed under the backup roll T2*a* so as to be movable between a position where the secondary transfer roll T2*b* is separated from the backup roll T2*a* and a position where the secondary transfer roll T2*b* is brought into contact with the backup roll T2*a*. A secondary transfer region Q4 is formed of a region of contact between the backup roll T2*a* and the secondary transfer roll T2*b*. A secondary transfer voltage reverse in polarity to the charged toner used in the developing device G is supplied to the backup roll T2*a* from a power supply circuit E. The power supply circuit E is controlled by a controller C as an example of a control portion. The backup roll T2*a* and the secondary transfer roll T2*b* form a secondary transfer unit T2 according to exemplary embodiment 1.

Recording sheets S as an example of media received in a sheet feed tray TR1 or TR2 as an example of a medium supply portion are picked up by a pickup roll Rp at a predetermined time, separated one by one by a separation roll Rs, and conveyed to a sheet supply path SH1. The pickup roll Rp is an example of a medium pickup member. The separation roll Rs is an example of a medium separating member. The sheet supply path SH1 is an example of a medium supply path. Each of the recording sheets S supplied to the sheet supply path SH1 is conveyed to a registration roll Rr by plural of conveyance rolls Ra. The registration roll Rr is an example of a medium conveyance timing control member. Each of the conveyance rolls Ra is an example of a medium conveying member. Each of the recording sheets S conveyed to the registration roll Rr is conveyed to a secondary transfer region Q4 from a pre-transfer sheet guide SG1 in synchronization with movement of the primarily transferred multi-color or mono-color toner image to the secondary transfer region Q4. The pre-transfer sheet guide SG1 is an example of a pre-transfer medium guide member. The secondary transfer unit T2 secondarily transfers the toner image from the intermediate transfer belt B onto the recording sheet S at the secondary transfer region Q4. The intermediate transfer belt B after the secondary transfer is cleaned by a belt cleaner CL2 so that residual toner is removed from the intermediate transfer belt B. The belt cleaner CL2 is an example of an intermediate transferer cleaning unit.

The secondary transfer roll T2*b* and the belt cleaner CL2 are disposed so as to be separated from and brought into contact with the intermediate transfer belt B desirably. For formation of a color image, the secondary transfer roll T2*b* and the belt cleaner CL2 are separated from the intermediate transfer belt B until an unfixed toner image of a final color is primarily transferred onto the intermediate transfer belt B.

The recording sheet S having the toner image or images secondarily transferred thereon is conveyed to a fixing region Q5 by a post-transfer sheet guide SG2 and a sheet conveying belt BH. The post-transfer sheet guide SG2 is an example of a post-transfer medium guide member. The sheet conveying belt BH is an example of a medium adsorbing/conveying member. The fixing region Q5 is a region where a heating roll Fh as an example of a heating member of a fixing device F and a pressure roll Fp as an example of a pressure member come into pressure contact with each other. The recording sheet S passing through the fixing region Q5 is thermally fixed by the fixing device F.

The recording sheet S having the toner image or images fixed thereon is conveyed in a sheet ejection path SH2 on a downstream side of the fixing region Q5 and ejected to the outside through a sheet ejection port Rha by a sheet ejection roll Rh. The sheet ejection path SH2 is an example of a medium ejection path. The sheet ejection roll Rh is an example of a medium ejection member. The sheet ejection port Rha is an example of a medium ejection port. The recording sheet S ejected through the sheet ejection port Rha is stacked on a sheet ejection tray TRh which is an example of a medium ejection portion.

A sheet reversing path SH3 on an upstream side of the sheet ejection roll Rh is connected to the sheet ejection path SH2. The sheet reversing path SH3 is an example of a medium reversing path. A switching gate GT1 as an example of a destination switching member is provided in a connection portion between the sheet ejection path SH2 and the sheet reversing path SH3. The switching gate GT1 selectively switches the recording sheet S conveyed in the sheet ejection path SH2 to either the side of the sheet ejection roll Rh or the side of the sheet reversing path SH3.

A sheet circulation path SH4 as an example of a medium circulation path is connected to the sheet reversing path SH3. A switching gate GT2 as an example of a second destination switching member is provided in a connection portion between the sheet reversing path SH3 and the sheet circulation path SH4. The switching gate GT2 is formed so that the recording sheet S conveyed in the sheet reversing path SH3 from the switching gate GT1 is made to pass through the switching gate GT2 directly, and that the recording sheet S once passed through the switching gate GT2 and then sent back to the switching gate GT2 is made to go to the side of the sheet circulation path SH4. The recording sheet S conveyed in the sheet circulation path SH4 passes through the sheet supply path SH1 and is sent to the secondary transfer region Q4 again. A sheet conveyance path SH as an example of a medium conveyance path is composed of elements designated by the symbols SH1 to SH4. In addition, a sheet conveyance device SU as an example of a medium conveyance device is composed of elements designated by the symbols Rp, Rs, Rr, Ra, SG1, SG2 and BH.

Figure 3A:
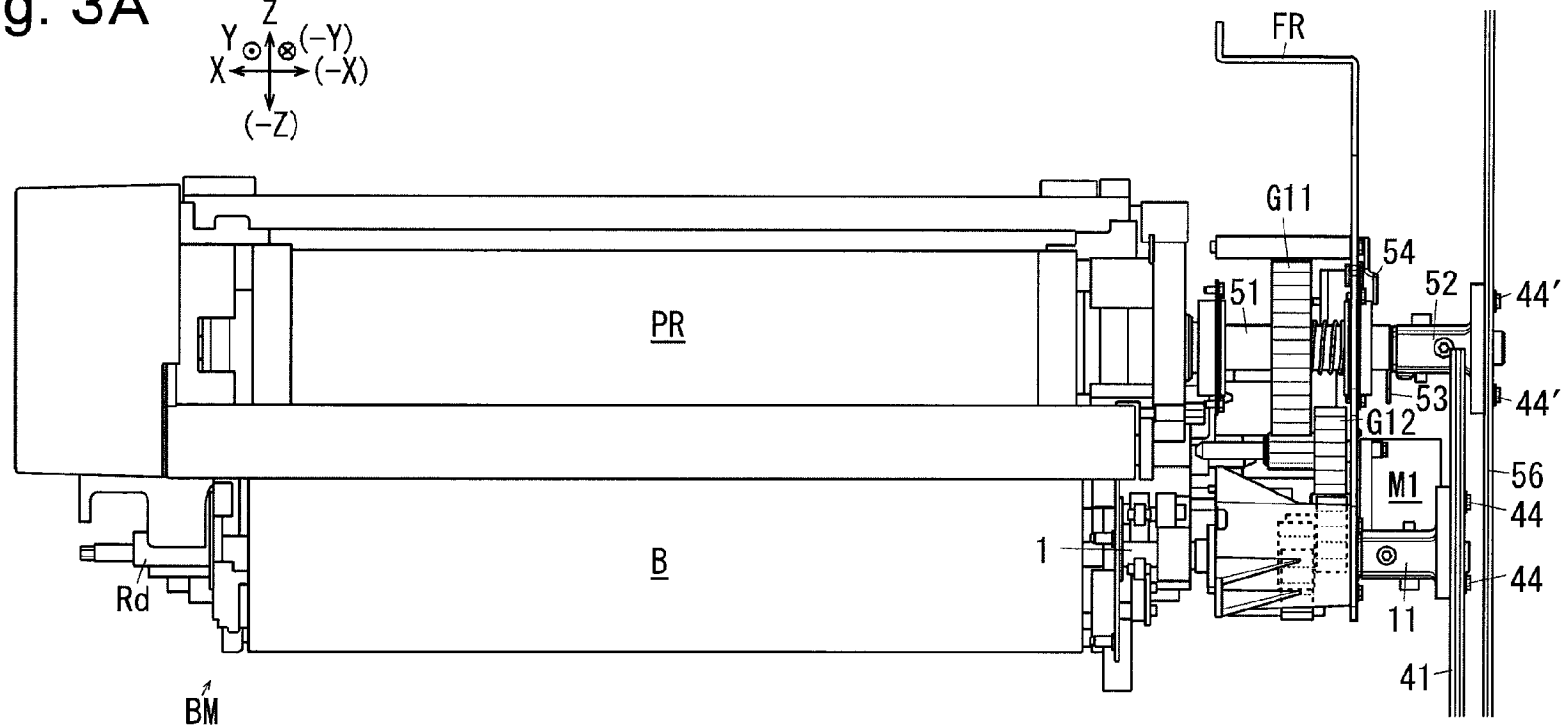
FIGS. 3A and 3B are explanatory views showing the belt module and the photoconductor drum according to exemplary embodiment 1 of the invention, specifically
Figure 3B:
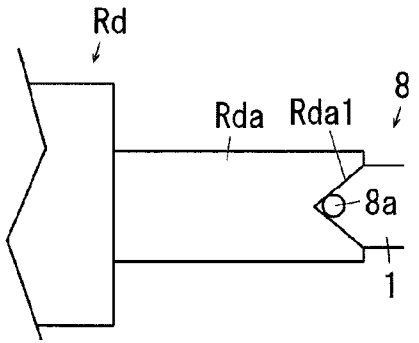

FIGS. 3A and 3B are explanatory views showing the belt module and the photoconductor drum according to exemplary embodiment 1 of the invention. Specifically, FIG. 3A is an explanatory view of the belt module and the photoconductor drum when seen from the right, and FIG. 3B is an explanatory view of a belt driving roll and a belt driving shaft.

Figure 4A:
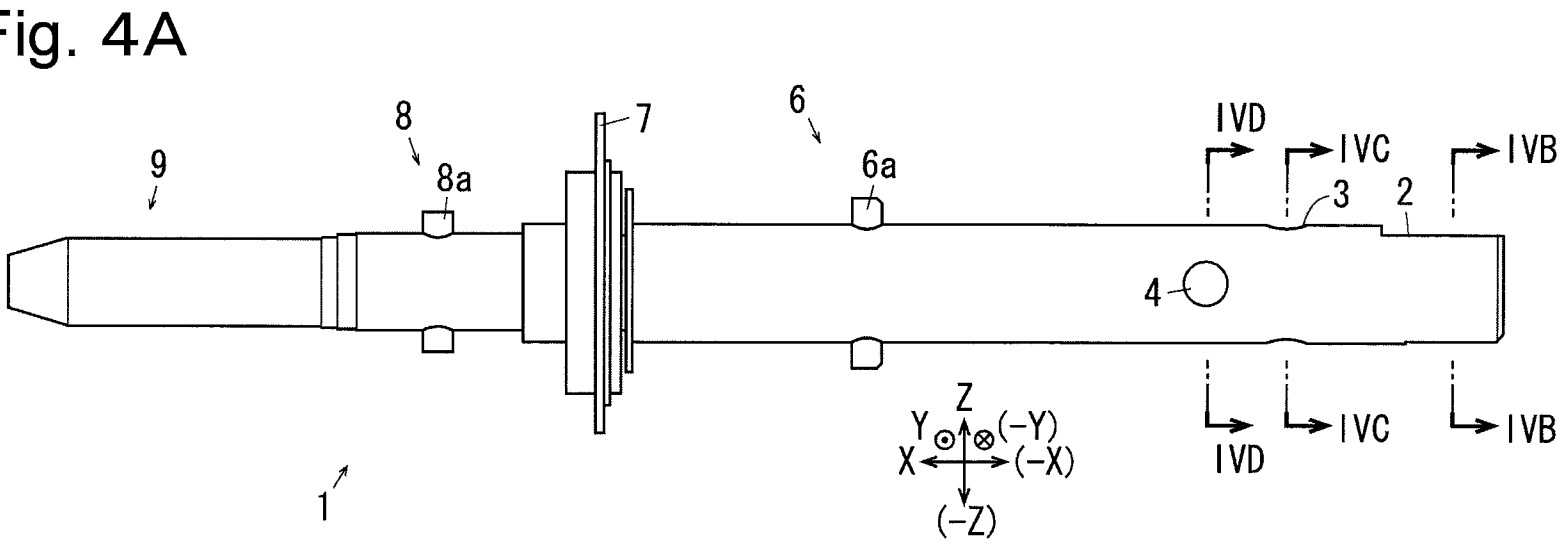
FIGS. 4A to 4D are explanatory views showing the belt driving shaft according to exemplary embodiment 1 of the invention, specifically
Figure 4D:
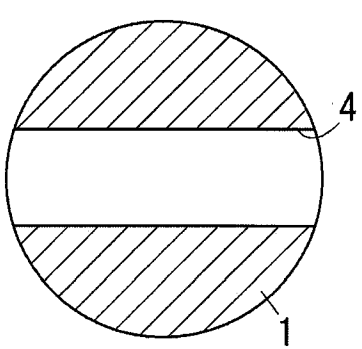
Figure 4C:
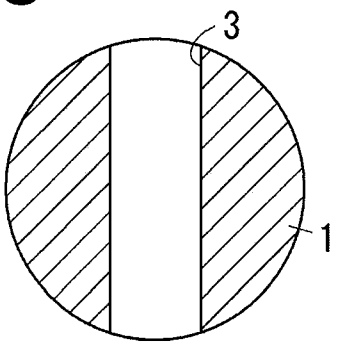
Figure 4B:
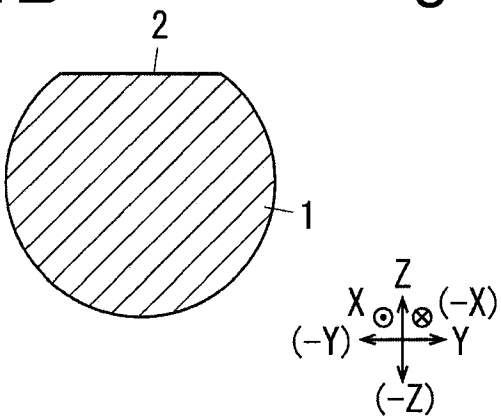

FIGS. 4A to 4D are explanatory views showing the belt driving shaft according to exemplary embodiment 1 of the invention. Specifically, FIG. 4A is an explanatory view of a rear end portion of the belt driving shaft, FIG. 4B is a sectional view taken along the line IVB-IVB in FIG. 4A, FIG. 4C is a sectional view taken along the line IVC-IVC in FIG. 4A, and FIG. 4D is a sectional view taken along the line IVD-IVD in FIG. 4A.

In FIGS. 3A and 3B, the belt driving shaft 1 as an example of a driving shaft of the intermediate transferer is provided in the rear of the belt module BM so as to be supported rotatably on a frame FR which is an example of a frame body.

In FIGS. 3A and 3B and FIGS. 4A to 4D, the belt driving shaft 1 is shaped like a column extending in the front-rear direction. In FIGS. 4A to 4D, a D cut portion 2 as an example of a regulated portion is formed in a rear end portion (as an example of an end portion in an axial direction of a rotation shaft) of the belt driving shaft 1. The D cut portion 2 is formed in such a manner that a part of the columnar belt driving shaft 1 is cut in a plane frontward from the rear end. As shown in FIG. 4B, the section of the D cut portion 2 is shaped like a D figure. That is, the rear end side of the rear end portion of the belt driving shaft 1 according to exemplary embodiment 1 is formed as a D cut shape which is an external shape different from the columnar shape which is an external shape of the other portion of the belt driving shaft 1 than the rear end side of the rear end portion thereof.

In FIGS. 4A to 4D, a rear screw pass-through hole 3 as an example of a first through hole provided in a rotation shaft is formed in front of the D cut portion 2 so that the rear screw pass-through hole 3 passes through the belt driving shaft 1 in a direction intersecting the axial direction of the belt driving shaft 1. The rear screw pass-through hole 3 according to exemplary embodiment 1 passes through the belt driving shaft 1 in a radial direction which is perpendicular to the axial direction of the belt driving shaft 1 and which passes through the axial center of the belt driving shaft 1. In FIGS. 4A and 4C, the rear screw pass-through hole 3 passes through the belt driving shaft 1 in the up-down direction.

A front screw pass-through hole 4 as an example of a second through hole provided in the rotation shaft is formed in front of the rear screw pass-through hole 3 so that the front screw pass-through hole 4 passes through the belt driving shaft 1 in a direction which intersects the axial direction of the belt driving shaft 1 and intersects the passing through direction of the rear screw pass-through hole 3. The front screw pass-through hole 4 according to exemplary embodiment 1 passes through the belt driving shaft 1 in a radial direction which is perpendicular to the axial direction of the belt driving shaft 1 and perpendicular to the passing through direction of the rear screw pass-through hole 3 and which passes through the axial center of the belt driving shaft 1. In FIGS. 4A and 4D, the front screw pass-through hole 4 passes through the belt driving shaft 1 in the left-right direction.

Accordingly, the D cut portion 2 is formed at the rear end in the rear end portion of the belt driving shaft 1. The rear screw pass-through hole 3 is formed in a position shifted frontward from the D cut portion 2. The front screw pass-through hole 4 is formed in a position shifted frontward from the rear screw pass-through hole 3.

Screw pass-through holes 3+4 as an example of through holes provided in the rotation shaft according to exemplary embodiment 1 are formed from the rear screw pass-through hole 3 and the front screw pass-through hole 4.

In FIG. 4A, a gear fixing portion 6 as an example of a portion supporting a transmission member for transmitting a driving force is formed in front of the through holes 3+4 in the belt driving shaft 1. The gear fixing portion 6 according to exemplary embodiment 1 includes a rod-like member 6*a* which is supported in a state where the rod-like member 6*a* passes through the belt driving shaft 1 radially while opposite ends of the rod-like member 6*a* protrude outward radially.

A bearing portion 7 is provided in front of the gear fixing portion 6 so as to be supported rotatably on a frame body not shown.

A driving fixation portion 8 as an example of a portion supporting the transmission member for transmitting a driving force is formed in front of the bearing portion 7. The driving fixation portion 8 according to exemplary embodiment 1 includes a rod-like member 8*a* which is supported in a state where the rod-like member 8*a* passes through the belt driving shaft 1 radially while opposite ends of the rod-like member 8*a* protrude outward radially.

A boss portion 9 as an example of a leading end portion is formed in a front end portion of the belt driving shaft 1. The boss portion 9 has a tapered front end.

Figures 5A, 5B:
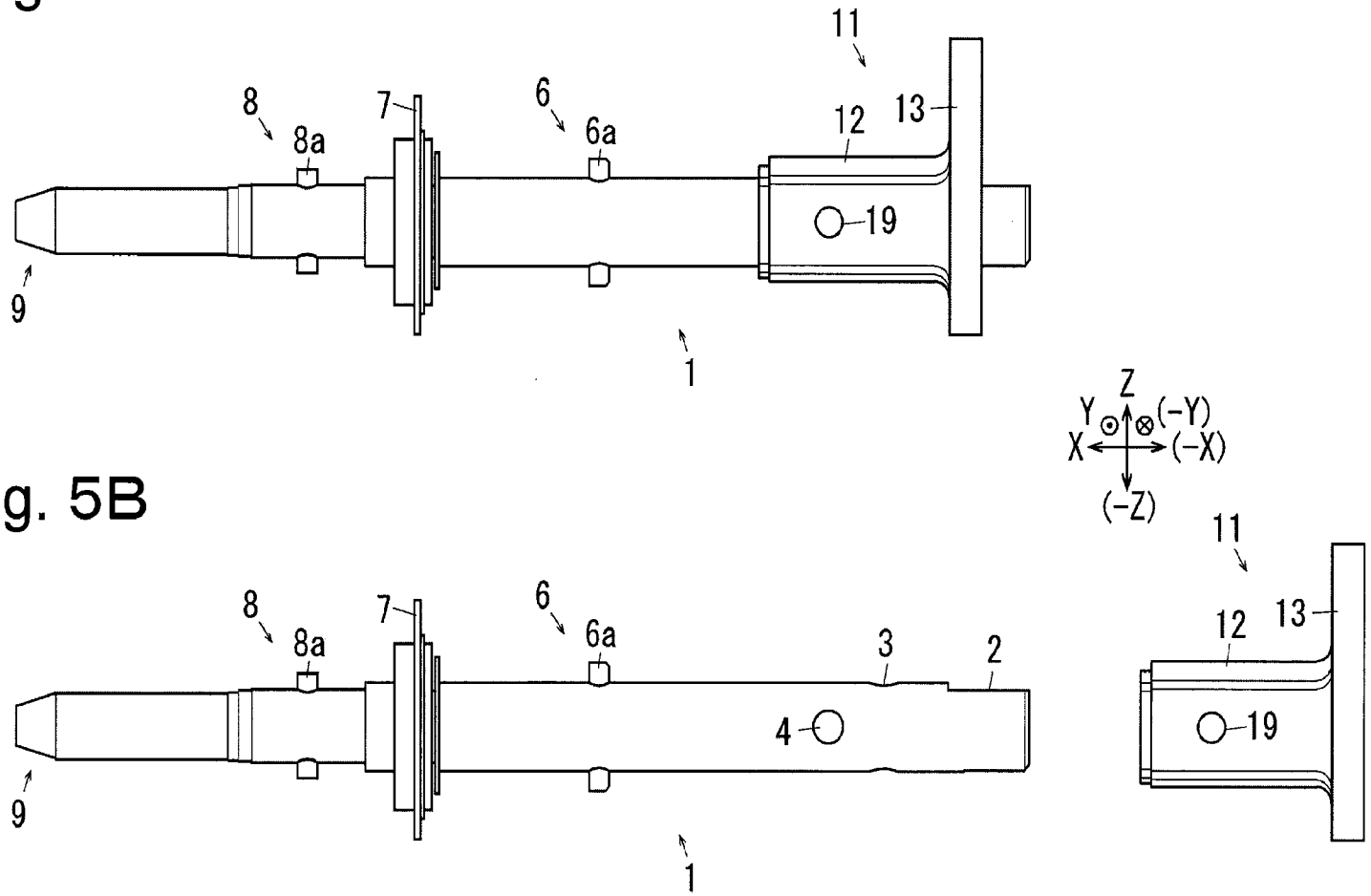
FIG. 5A is an explanatory view of a state where the holder has been already put on the belt driving shaft.
FIG. 5B is an explanatory view of a state where the holder has been not put on the belt driving shaft yet.

FIGS. 5A and 5B are explanatory view showing the belt driving shaft and a holder according to exemplary embodiment 1 of the invention. Specifically, FIG. 5A is an explanatory view showing a state where the holder has been already put on the belt driving shaft, and FIG. 5B is an explanatory view showing a state where the holder has not been put on the belt driving shaft yet.

Figure 6A:
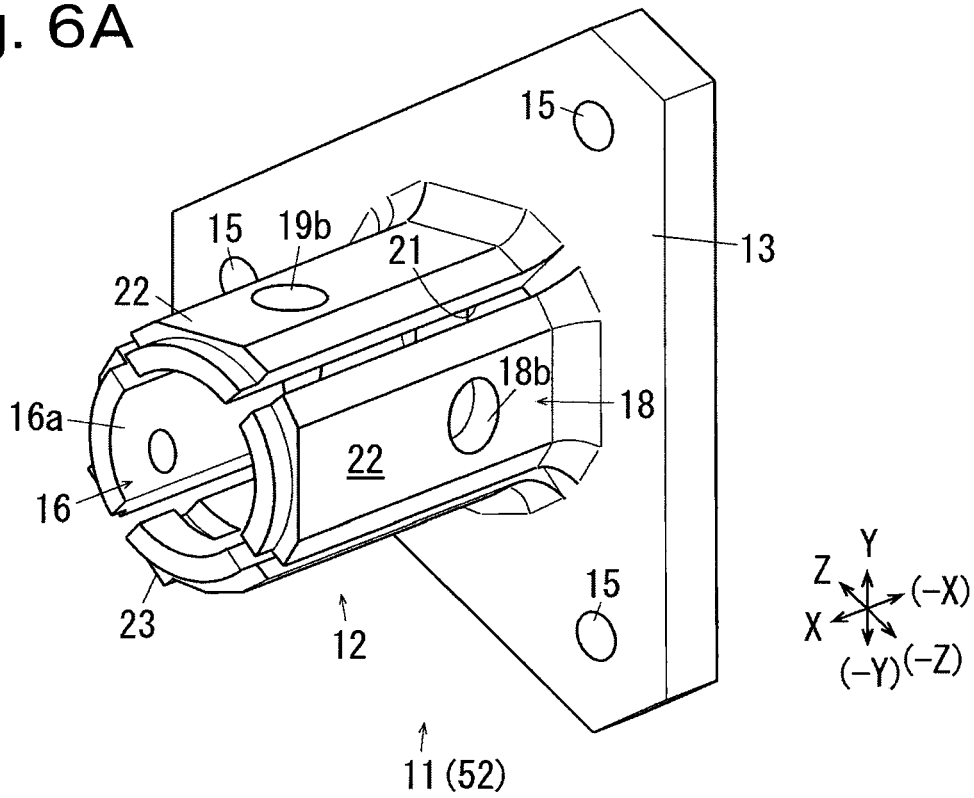
FIGS. 6A and 6B are perspective views showing the holder according to exemplary embodiment 1 of the invention, specifically
Figure 6B:
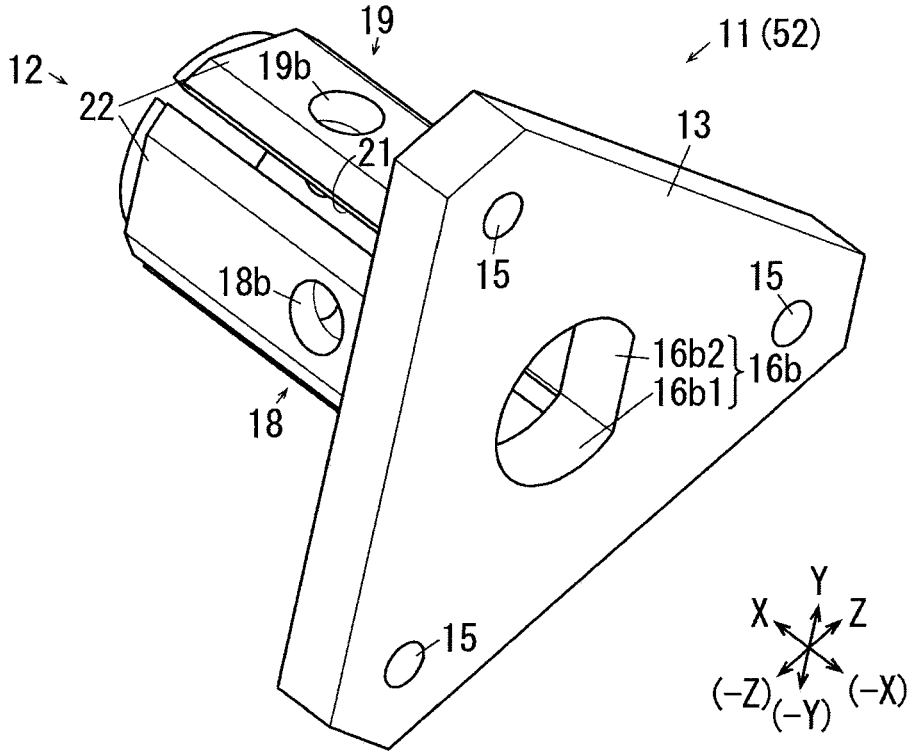

FIGS. 6A and 6B are perspective views of the holder according to exemplary embodiment 1 of the invention. Specifically, FIG. 6A is a perspective view when seen from a lower right front side, and FIG. 6B is a perspective view when seen from a lower right rear side.

Figure 7E:
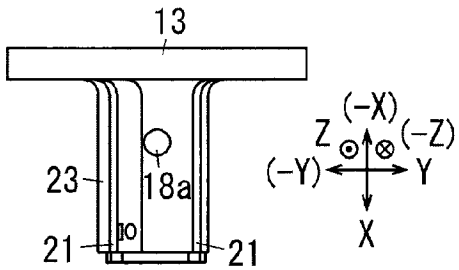
FIGS. 7A to 7E are explanatory views showing the holder according to exemplary embodiment 1 of the invention, specifically
Figure 7A:
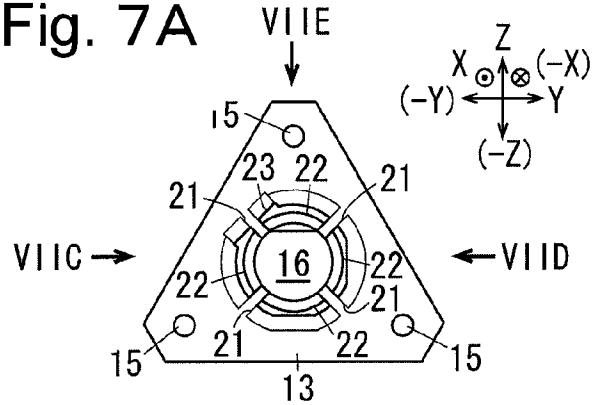
Figure 7B:
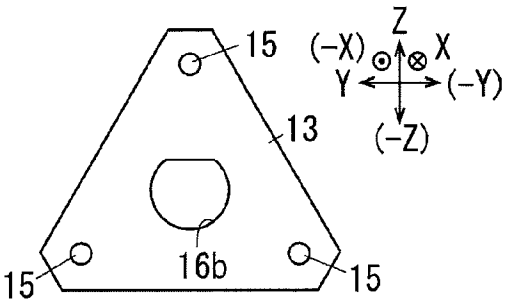
Figure 7C:
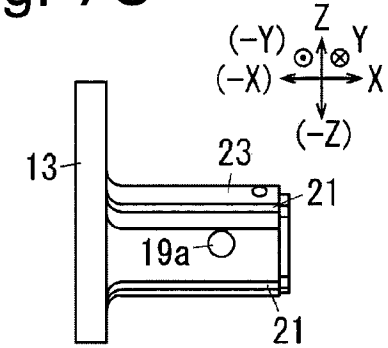
Figure 7D:
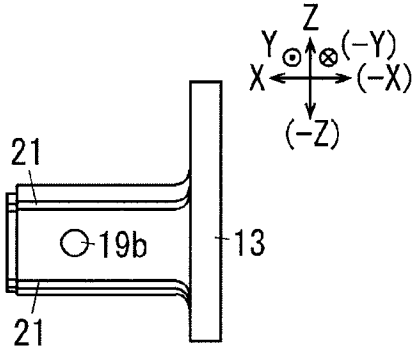

FIGS. 7A to 7E are explanatory views of the holder according to exemplary embodiment 1 of the invention. Specifically, FIG. 7A is an explanatory view when seen from the front, FIG. 7B is an explanatory view when seen from the rear, FIG. 7C is an explanatory view from a direction of an arrow VIIC in FIG. 7A, FIG. 7D is an explanatory view from a direction of an arrow VIID in FIG. 7A, and FIG. 7E is an explanatory view from a direction of an arrow VIIE in FIG. 7A.

In FIGS. 3A and 3B and FIGS. 5A and 5B, a holder 11 as an example of a holding member is supported on the rear end portion of the belt driving shaft 1.

In FIGS. 6A and 6B and FIGS. 7A to 7E, the holder 11 has a fixation cylinder 12 shaped like a pipe extending in the front-rear direction as an example of a cylindrical portion, and a wheel support plate 13 as an example of a support portion on which a stabilizing member disposed at a rear end of the fixation cylinder 12 is supported. The wheel support plate 13 according to exemplary embodiment 1 is formed as a plate having an external shape of a regular triangle whose gravitational center is located so as to correspond to the cylindrical center of the fixation cylinder 12. Wheel fixing holes 15 as an example of fixation holes for fixing the stabilizing member are formed in the wheel support plate 13 so that the wheel fixing holes 15 pass through the wheel support plate 13 in the front-rear direction. Three holes in total are formed as the wheel fixing holes 15 in correspondence to corner portions of the regular triangular shape of the wheel support plate 13. Each of the wheel fixing holes 15 is formed at an equal distance from the gravitational center of the wheel support plate 13.

Figure 8A:
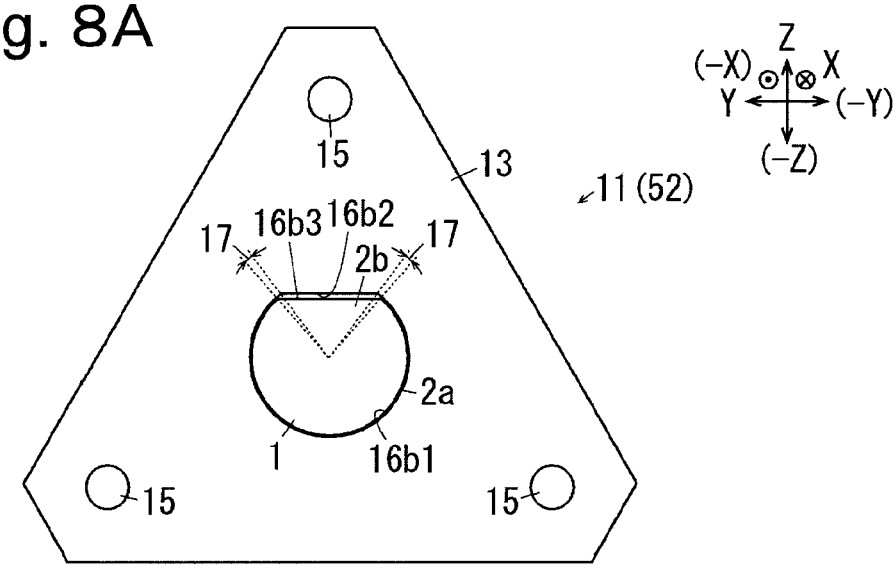
FIG. 8A is an explanatory view of a state where the belt driving shaft has not rotated relative to the holder yet.
Figure 8B:
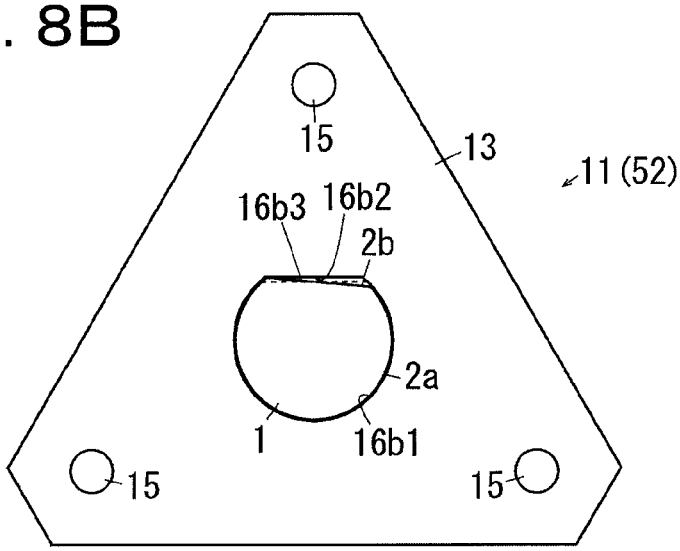
FIG. 8B is an explanatory view of a state where the belt driving shaft has rotated right relative to the holder when seen from the rear.
Figure 8C:
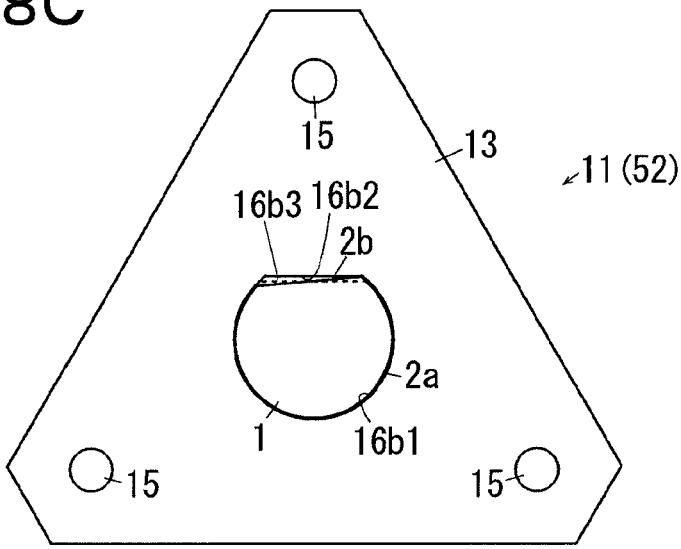
FIG. 8C is an explanatory view of a state where the belt driving shaft has rotated left relative to the holder when seen from the rear.

FIGS. 8A to 8C are explanatory views showing the D cut portion and a receiving hole according to exemplary embodiment 1 of the invention. Specifically, FIG. 8A is an explanatory view of a state where the belt driving shaft has not rotated relative to the holder yet, FIG. 8B is an explanatory view of a state where the belt driving shaft has already rotated right relative to the holder when seen from the rear side, and FIG. 8C is an explanatory view of a state where the belt driving shaft has already rotated left relative to the holder when seen from the rear side.

In FIGS. 6A and 6B and FIGS. 7A to 7E, a holding hole 16 is formed in the fixation cylinder 12 so that the holding hole 16 passes through the inside of the fixation cylinder 12 in the front-rear direction. The holding hole 16 is formed to have an inner diameter corresponding to the outer diameter of the belt driving shaft 1. The holding hole 16 has a support portion 16*a* into which the rear end portion of the belt driving shaft 1 is inserted, and a receiving hole 16*b* which is provided as an example of a regulating portion and formed so as to be continued to a rear side of the support portion 16*a*.

In FIGS. 6A and 6B, FIGS. 7A to 7E and FIGS. 8A to 8C, the receiving hole 16*b* is shaped like a D cut which passes through the wheel support plate 13 in the front-rear direction, as an example of a shape into which the D cut portion 2 of the belt driving shaft 1 may be fitted.

In FIGS. 8A to 8C, the receiving hole 16*b* has a circular curved surface portion 16*b*1, and a linear flat surface portion 16*b*2. The circular curved surface portion 16*b*1 has an inner diameter corresponding to an outer diameter of a circular curved surface portion 2*a* of the D cut portion 2. The linear flat surface portion 16*b*2 is formed on a radial outer side than a linear flat surface portion 2*b* of the D cut portion 2. That is, in FIG. 8A, the D cut portion 2 is fitted into the receiving hole 16*b* in a state where the curved surface portion 2*a* of the D cut portion 2 is brought into contact with the curved surface portion 16*b*1 of the receiving hole 16*b* while the flat surface portion 2*b* of the D cut portion 2 is separated from the flat surface portion 16*b*2 of the receiving hole 16*b*. On this occasion, a gap 16*b*3 of the receiving hole 16*b* as an example of a first gap is formed between the receiving hole 16*b* and the D cut portion 2.

Here, the gap 16*b*3 of the receiving hole 16*b* is a so-called looseness or clearance which is formed for inserting the belt driving shaft 1 into the holding hole 16 for assemblage. The belt driving shaft 1 may rotate relative to the holder 11 only by the gap 16*b*3 of the receiving hole 16*b* with respect to the D cut portion 2 along a direction of rotation relative to the belt driving shaft 1. The belt driving shaft 1 and the holder 11 rotate relative to each other only by the gap 16*b*3 of the receiving hole 16*b*. As shown in FIGS. 8B and 8C, when a boundary portion between the curved surface portion 2*a* of the D cut portion 2 and the flat surface portion 2*b* of the D cut portion 2 comes into contact with the flat surface portion 16*b*2 of the receiving hole 16*b*, relative rotation of the belt driving shaft 1 and the holder 11 is regulated so that the belt driving shaft 1 and the holder 11 rotate integrally.

Accordingly, in FIG. 8A, a possible angle 17 is formed as an example of a range in which the belt driving shaft 1 may rotate relative to the holder 11 only by the gap 16*b*3 of the receiving hole 16*b* along the direction of rotation.

Incidentally, the receiving hole 16*b* is formed so that the length of the receiving hole 16*b* in the front-rear direction is smaller than that of the D cut portion 2 of the belt driving shaft 1. When the belt driving shaft 1 is fitted into the receiving hole 16*b*, the rear portion of the D cut portion 2 protrudes rearward from the holder 11 as shown in FIG. 5A.

In FIGS. 6A and 6B and FIGS. 7A to 7E, a pair of upper and lower rear through holes 18 which pass through the fixation cylinder 12 in correspondence to the rear screw pass-through hole 3 of the belt driving shaft 1 are formed, as an example of first through holes provided in the cylindrical portion, in the fixation cylinder 12. The pair of rear through holes 18 according to exemplary embodiment 1 are composed of a rear screw hole 18*a* and a rear passage hole 18*b*. The rear screw hole 18*a* has a thread groove which is cut in an inner circumference. The rear passage hole 18*b* faces the rear screw hole 18*a* and has a diameter larger than that of the rear screw hole 18*a*.

In addition, a pair of left and right front through holes 19 as an example of second through holes provided in the cylindrical portion are formed in the fixation cylinder 12. The pair of front through holes 19 are formed in correspondence to the screw pass-through hole 4 of the belt driving shaft 1. The pair of front through holes 19 according to exemplary embodiment 1 are composed of a front screw hole 19*a* and a front passage hole 19*b*. The front screw hole 19*a* has a thread groove which is cut in the inner circumference. The front passage hole 19*b* faces the front screw hole 19*a* and has a diameter larger than that of the front screw hole 19*a*.

Screw holes 18+19 as an example of through holes provided in the cylindrical portion in exemplary embodiment 1 are composed of the rear through holes 18 and the front through holes 19.

In FIGS. 6A and 6B and FIGS. 7A to 7E, slit portions 21 as an example of notch portions are formed in the fixation cylinder 12. Each of the slit portions 21 extends from a leading end portion of the fixation cylinder 12 toward a base end portion of the fixation cylinder 12, i.e. from the front end of the fixation cylinder 12 toward the rear end of the fixation cylinder 12. In FIG. 7A, the slit portions 21 according to exemplary embodiment 1 are formed at regular intervals along the circumferential direction of the fixation cylinder 12. Each slit portion 21 is formed between two screw holes 18 and 19 circumferentially adjacent to each other, so that four slit portions 21 in total are formed in the fixation cylinder 12 according to exemplary embodiment 1.

In this manner, in the fixation cylinder 12, four partial cylinder wall portions 22 put between the slit portions 21 may be deformed elastically with the wheel support plate 13 side used as a base end, so that the fixation cylinder 12 may be deformed easily in the radial direction of the fixation cylinder 12, compared with the case where there is no slit portion 21 formed in the fixation cylinder 12.

In FIG. 7A, in exemplary embodiment 1, outer circumferential portions of the partial cylinder wall portions 22 in which the rear passage hole 18*b* and the front passage hole 19*b* are provided are shaped like flat surfaces in correspondence with screw heads of clamp screws 31 and 32 which will be described later, respectively.

In exemplary embodiment 1, a support portion 23 for supporting a detected member is formed in an outer circumferential portion of a left upper part of the fixation cylinder 12 in FIG. 6A and FIGS. 7A to 7E. The support portion 23 has such a shape that the outer circumferential portion is cut into a flat surface.

Figure 9A:
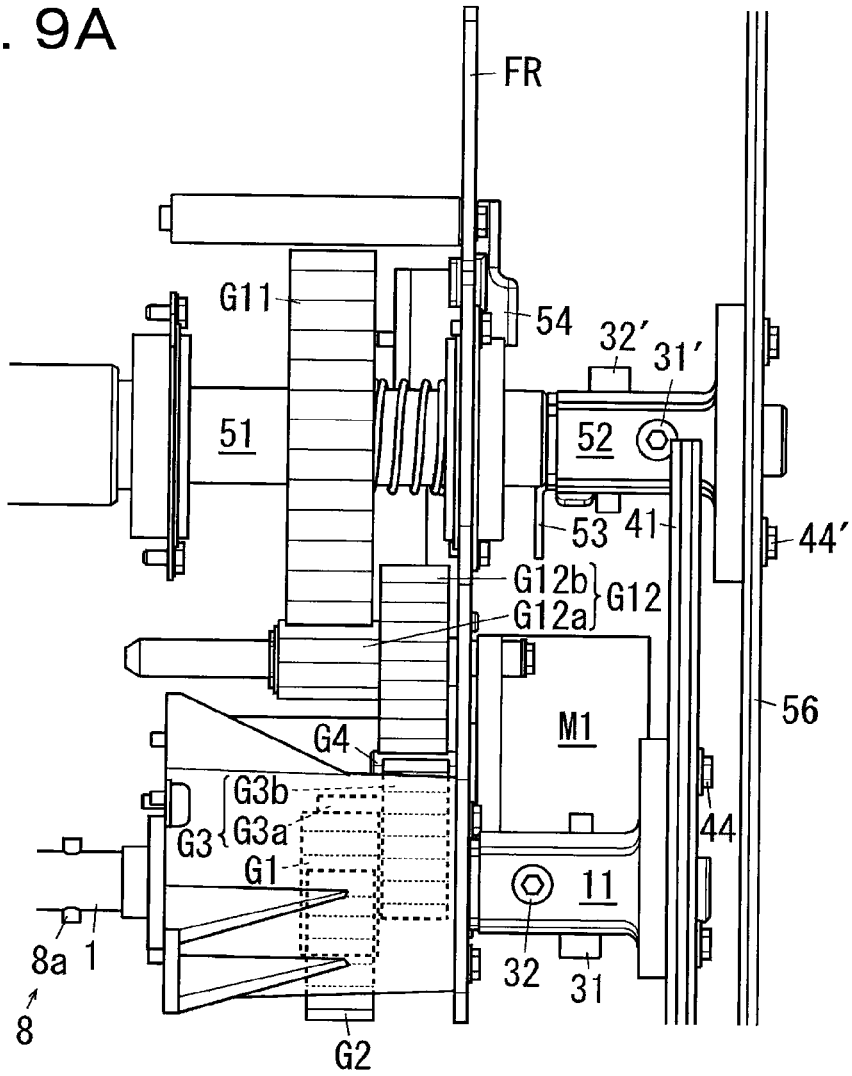
FIGS. 9A and 9B are explanatory views showing rear end portions of an intermediate transfer belt and the photoconductor drum according to exemplary embodiment 1 of the invention, specifically
Figure 9B:
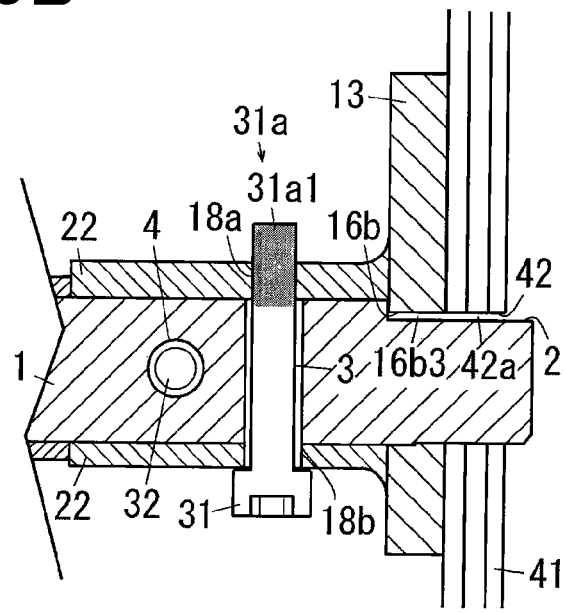

FIGS. 9A and 9B are explanatory views showing rear end portions of the intermediate transfer belt and the photoconductor drum according to exemplary embodiment 1 of the invention. Specifically, FIG. 9A is an enlarged view of important part in FIG. 3A, and FIG. 9B is a sectional view of the rear end portion of the belt driving shaft in FIG. 9A.

In FIGS. 3A and 3B and FIGS. 9A and 9B, the holder 11 is fixed to the belt driving shaft 1 by a rear clamp screw 31 and a front clamp screw 32 in the condition that the belt driving shaft 1 is inserted into the holding hole 16. The rear clamp screw 31 as an example of a first clamp member has a diameter corresponding to the diameter of the rear screw hole 18*a*. The front clamp screw 32 as an example of a second clamp member has a diameter corresponding to the diameter of the front screw hole 19*a*.

That is, a leading end portion 31*a* of the rear clamp screw 31 passes through the rear screw pass-through hole 3 from the rear passage hole 18*b* so as to be screwed into the rear screw hole 18*a*. When the rear clamp screw 31 is fastened, parts of the fixation cylinder 12, i.e. a pair of partial cylinder wall portions 22 which are opposite to each other with interposition of the belt driving shaft 1 are clamped on the belt driving shaft 1 so that inner walls of the partial cylinder wall portions 22 are brought into tight contact with the belt driving shaft. In this manner, the holder 11 is fixed to the belt driving shaft 1.

Similarly, a leading end portion 32*a* of the front clamp screw 32 passes through the front screw pass-through hole 4 from the front passage hole 19*b* so as to be screwed into the front screw hole 19*a*. When the front clamp screw 32 is fastened, a pair of partial cylinder wall portions 22 opposite to each other with interposition of the belt driving shaft 1 are clamped on the belt driving shaft 1 so that inner walls of the partial cylinder wall portions 22 are brought into tight contact with the belt driving shaft 1. In this manner, the holder 11 is fixed to the belt driving shaft 1.

In this manner, the inner wall of the fixation cylinder 12 comes into surface contact with the belt driving shaft 1. Even when one of the belt driving shaft 1 and the holder 11 intends to rotate relative to the other, friction force acts on the contact surface therebetween so that the belt driving shaft 1 and the holder 11 rotate integrally.

Slack preventing portions 31*a*1 and 32*a*1 as an example of suppression portions are provided in the leading end portions 31*a* and 32*a* of the clamp screws 31 and 32. Slack preventing treatment well known in the background art is applied to the slack preventing portions 31*a*1 and 32*a*1 to suppress the leading end portions 31*a* and 32*a* from moving to drop out from the screw holes 18*a* and 19*a*, so that the state where the inner walls of the partial cylinder wall portions 22 are in tight contact with the belt driving shaft 1 may be kept. Incidentally, slack preventing treatment well known in the background art, such as treatment of applying a resin or changing an inclination quantity of a screw thread to increase friction force may be used as the slack preventing treatment.

Clamp members 31+32 according to exemplary embodiment 1 are composed of the rear clamp screw 31 and the front clamp screw 32.

FIGS. 10A to 10F are explanatory views showing the screw pass-through holes and the clamp screws due to relative rotation of the belt driving shaft and the holder according to exemplary embodiment 1 of the invention. Specifically, FIG. 10A is an explanatory view corresponding to FIG. 8A about the rear screw pass-through hole and the rear clamp screw, FIG. 10B is an explanatory view corresponding to FIG. 8B about the rear screw pass-through hole and the rear clamp screw, FIG. 10C is an explanatory view corresponding to FIG. 8C about the rear screw pass-through hole and the rear clamp screw, FIG. 10D is an explanatory view corresponding to FIG. 8A about the front screw pass-through hole and the front clamp screw, FIG. 10E is an explanatory view corresponding to FIG. 8B about the front screw pass-through hole and the front clamp screw, and FIG. 10F is an explanatory view corresponding to FIG. 8C about the front screw pass-through hole and the front clamp screw.

In FIGS. 10A and 10D, the inner diameters of the screw pass-through holes 3 and 4 are formed to be larger than the external shapes of the clamp screws 31 and 32 respectively. In the condition that the holder 11 is clamped and fixed to the belt driving shaft 1 by the clamp screws 31 and 32, a rear screw gap 33 as an example of a rear-side second gap is formed between the rear screw pass-through hole 3 and the rear clamp screw 31. Similarly, a front screw gap 34 as an example of a front-side second gap is formed between the front screw pass-through hole 4 and the front clamp screw 32.

An allowable angle 36 as an example of a range in which the clamp screw 31 or 32 may rotate relative to the screw pass-through hole 3 or 4 only by the screw gap 33 or 34 (i.e. an clearance) along the rotation direction is formed by the screw gap 33 or 34. The allowable angle 36 is set to be larger than the possible angle 17.

Accordingly, even if the belt driving shaft 1 and the holder 11 rotate relative to each other, the relative rotation of the belt driving shaft 1 and the holder 11 is regulated because the D cut portion 2 and the receiving hole 16*b* come into contact with each other before the clamp screws 31 and 32 come into contact with inner surfaces of the screw pass-through holes 3 and 4. That is, the clamp screws 31 and 32 are held to be always separated from the inner surfaces of the screw pass-through holes 3 and 4 by the screw gaps 33 and 34 in the relative rotation direction of the belt driving shaft 1 and the holder 11.

Second gaps 33+34 according to exemplary embodiment 1 are composed of the rear screw gap 33 and the front screw gap 34.

Figure 11:
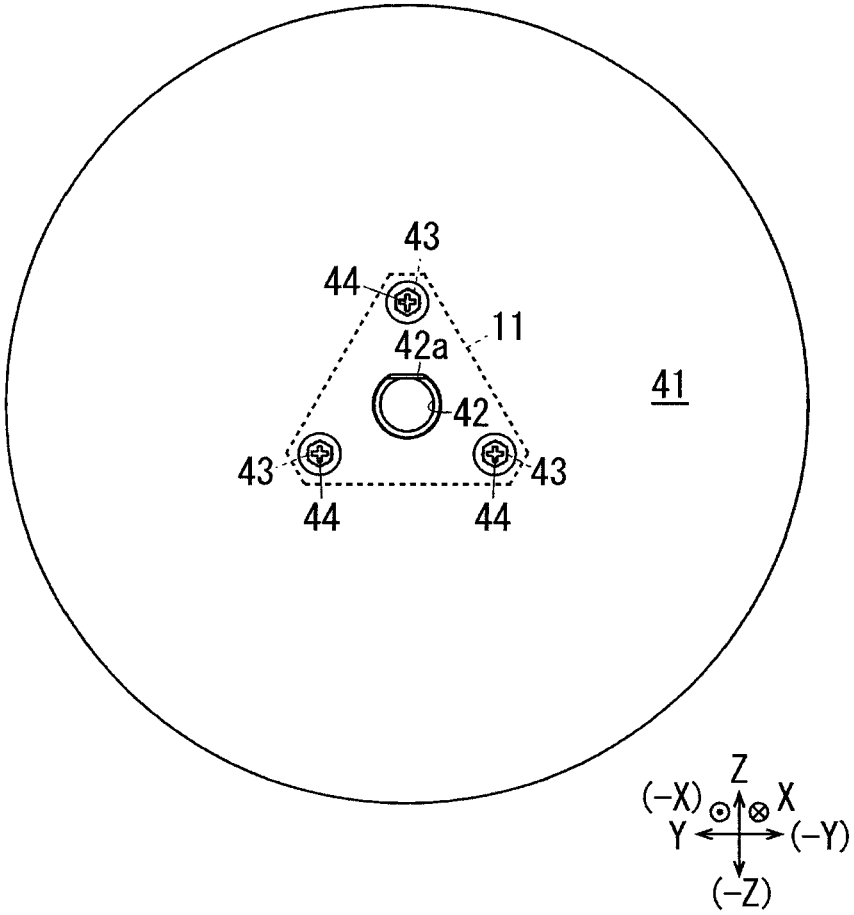
FIG. 11 is an explanatory view of the belt driving shaft and a flywheel according to exemplary embodiment 1 of the invention.
Figure 1:
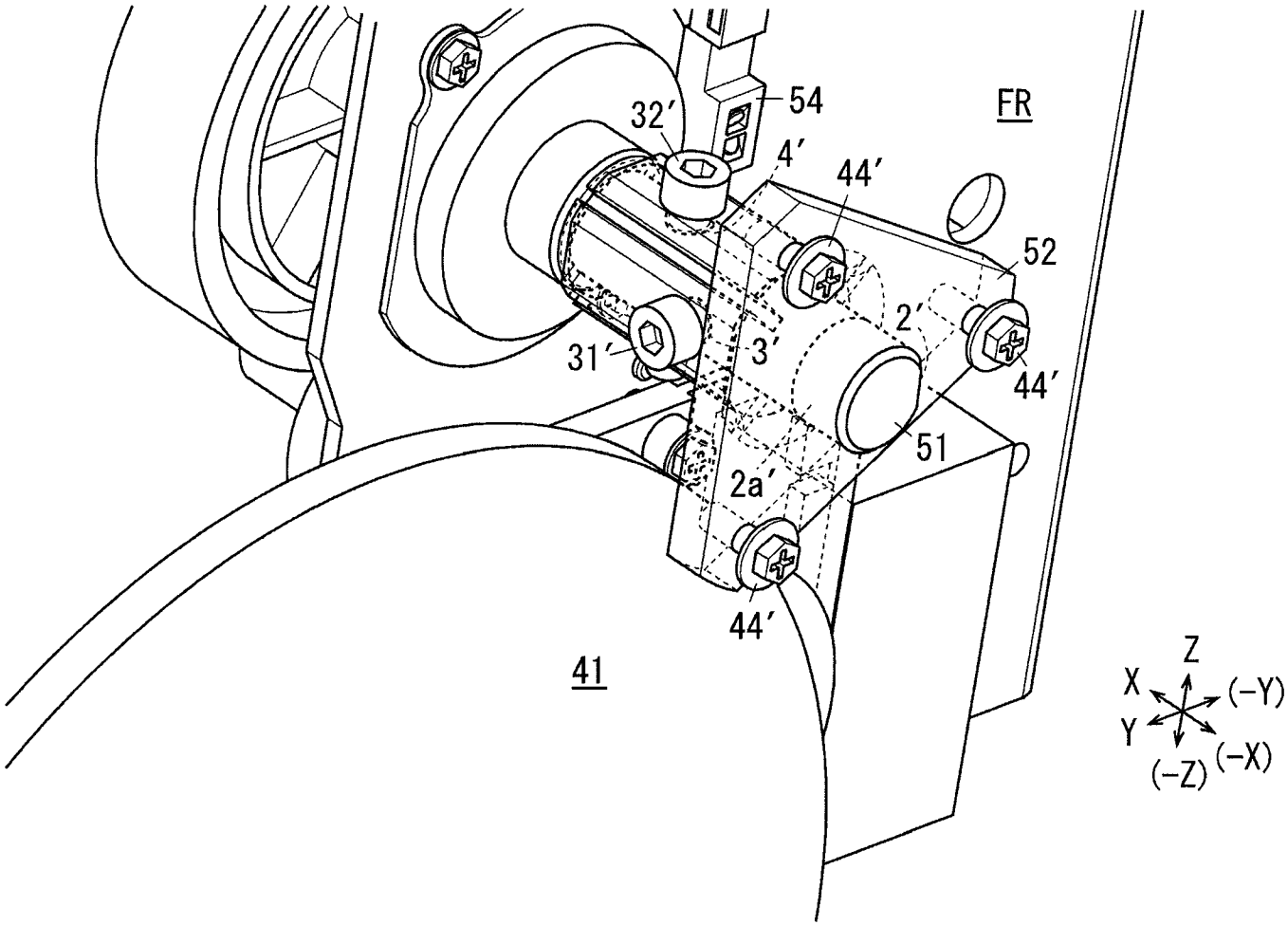

FIG. 11 is an explanatory view showing the belt driving shaft and a flywheel according to exemplary embodiment 1 of the invention.

In FIG. 3, FIGS. 9A and 9B and FIG. 11, a disk-like flywheel 41 supported on the belt driving shaft 1 and serving as an example of a second stabilizing member for stabilizing rotation of the intermediate transfer belt B is supported in the rear of the holder 11 fixed to the belt driving shaft 1.

In FIGS. 9A and 9B and FIG. 11, a D cut-like insertion hole 42 passing through the flywheel 41 in the front-rear direction and serving as an example of an inserted portion is formed in the disk center of the flywheel 41. The rear part of the D cut portion 2 of the belt driving shaft 1 protruding outward from the rear of the holder 11 as shown in FIG. 5A is inserted into the insertion hole 42.

Incidentally, the insertion hole 42 according to exemplary embodiment 1 is formed similarly to the receiving hole 16*b*. A gap 42*a* of the insertion hole 42 similar to the gap 16*b*3 of the receiving hole 16*b* is formed between the insertion hole 42 and the D cut portion 2.

In FIG. 11, three fixed holes 43 as an example of fixation holes of the stabilizing member are formed in the flywheel 41 in correspondence to the wheel fixing holes 15 of the holder 11 so as to be located in positions separated at radially equal distances from the insertion hole 42. Fixing screws 44 as an example of fixation members are inserted into the fixed holes 43 in the condition that the fixed holes 43 are aligned with the wheel fixing holes 15 of the wheel support plate 13.

In this manner, the flywheel 41 is screwed to the rear surface of the wheel support plate 13 by the fixing screws 44. On this occasion, the flywheel 41 is held on the belt driving shaft 1 by the holder 11 and may rotate integrally with the belt driving shaft 1 in the condition that the belt driving shaft 1 is inserted into the insertion hole 42.

Accordingly, the flywheel 41 comes into direct contact with the belt driving shaft 1 in the insertion hole 42 without interposition of any other member so that the rotation center of the flywheel 41 is determined by the belt driving shaft 1. In addition, the fixing screws 44 fix the flywheel 41 to the wheel support plate 13 in positions radially separated from the belt driving shaft 1 so that a load imposed on the fixing screws 44 due to rotation force, i.e. so-called torque of the belt driving shaft 1 relative to the flywheel 41 may be reduced compared with the case where the fixing screws 44 fix the flywheel 41 to the wheel support plate 13 in positions radially near to the belt driving shaft 1, i.e. positions near to the rotation center of the flywheel 41.

In FIG. 3A, FIG. 4A and FIG. 9A, a driven gear G1 serving as an example of a driven member and fitted and fixed onto the rod-like member 6*a* is supported on the gear fixing portion 6 of the belt driving shaft 1.

In FIG. 9A, an intermediate gear G2 serving as an example of an intermediate transmission member and supported rotatably on the frame FR is engaged with the left part of the driven gear G1. An intermediate gear G3 supported rotatably on the frame FR is disposed on an upper left side of the intermediate gear G2. The intermediate gear G3 has a small-diameter toothed wheel portion G3*a* engaged with the intermediate gear G2, and a large-diameter toothed wheel portion G3*b* larger in diameter than the small-diameter toothed wheel portion G3*a* and supported coaxially on the rear of the small-diameter toothed wheel portion G3*a*. A motor M1 as an example of a drive source is supported on the frame FR on an upper left side of the large-diameter toothed wheel portion G3*b*. A motor gear G4 as an example of a drive member of the drive source supported on a driving shaft of the motor M1 is engaged with the large-diameter toothed wheel portion G3*b*.

Accordingly, when the motor M1 drives to rotate the motor gear G4, a driving force is transmitted to the driven gear G1 through the gears G2 and G3 so that the driven gear G1 is rotated integrally with the belt driving shaft 1.

In FIG. 2, FIG. 3B and FIG. 4A, a cylindrical portion Rda of a belt driving roll Rd is put onto the boss portion 9 of the belt driving shaft 1. A groove portion Rd1 notched radially to be shaped like a V figure is provided in a rear end of the cylindrical portion Rda. The rod-like member 8*a* of the driving fixation portion 8 is fitted and connected into the groove portion Rda1 of the cylindrical portion Rda. In this manner, the belt driving roll Rd may be rotated integrally with the belt driving shaft 1.

Accordingly, when the belt driving shaft 1 is rotated by a driving force, the belt driving roll Rd is rotated integrally with the belt driving shaft 1 and the intermediate transfer belt B is also rotated by the belt driving roll Rd.

On this occasion, the flywheel 41 supported on the belt driving shaft 1 is rotated integrally with the belt driving shaft 1.

As for rotation with the belt driving shaft 1 as the rotation center, so-called moment of inertia increases by an amount of the flywheel 41. Accordingly, even when the belt driving shaft 1 receives a force for changing rotation with the belt driving shaft 1 as the rotation center, velocity change hardly occurs in the rotation direction so that rotation becomes stable.

That is, rotation of the belt driving shaft 1 is stabilized by the flywheel 41, so that rotation of the belt driving roll Rd connected to the belt driving shaft 1 and rotation of the intermediate transfer belt B driven by the belt driving roll Rd become also stable.

A belt rotation shaft 1+Rd as an example of a rotation shaft of a second rotary body and also as an example of a rotation shaft of an intermediate transferer is composed of the belt driving shaft 1 and the belt driving roll Rd.

FIG. 12 is a perspective view of a drum driving shaft according to exemplary embodiment 1 of the invention, when seen from the rear end. In FIG. 12, illustration of a flywheel for the drum driving shaft is omitted.

In FIG. 3A and FIG. 12, the drum driving shaft 51 as an example of a driving shaft of an image retainer is supported rotatably on the frame FR on the upper left side of the belt driving shaft 1.

A rear end portion of the drum driving shaft 51 is configured similarly to the rear end portion of the belt driving shaft 1 so that a D cut portion 2', a rear screw pass-through hole 3' and a front screw pass-through hole 4' are formed in the rear end portion of the drum driving shaft 51.

A holder 52 having the same configuration as the holder 11 and serving as an example of a first holding member is supported on the rear end portion of the drum driving shaft 51. The holder 52 is clamped by clamp screws 31' and 32' and supported on the drum driving shaft 51 in the same manner as the holder 11.

In FIG. 3A, FIG. 9A and FIG. 12, a detected member 53 is supported on a detected member support portion 23 of the holder 52. The detected member 53 is formed into a shape protruding radially outward from the drum driving shaft 51 so that the detected member 53 may rotate integrally with the holder 52. On this occasion, the detected member 53 passes through a detection region of a detecting member 54 supported on the frame FR. The passage of the detected member 53 is detected by the detecting member 54 so that the time per rotation is measured and the position of rotation of the photoconductor drum PR is detected.

In FIG. 3A and FIG. 12, a flywheel 56 as an example of a first stabilizing member for stabilizing rotation of the photoconductor drum PR is supported on the rear of the holder 52 fixed to the drum driving shaft 51. The flywheel 56 according to exemplary embodiment 1 has the same configuration as the flywheel 41 supported on the belt driving shaft 1 except that the flywheel 56 is formed to have a larger diameter and a smaller front-rear-direction thickness than those of the flywheel 41 supported on the belt driving shaft 1. The flywheel 56 supported on the drum driving shaft 51 is fastened to the holder 52 by fixing screws 44' in the condition that the D cut portion 2' of the drum driving shaft 51 is inserted into an insertion hole 42'.

In FIG. 3A, the drum driving shaft 51 is provided with a gear fixing portion on which a driven gear G11 is supported.

In FIG. 3A and FIG. 9A, an intermediate gear G12 supported rotatably on the frame FR is disposed under the driven gear G11. The intermediate gear G12 has a small-diameter toothed wheel portion G12*a* engaged with the driven gear G11, and a large-diameter toothed wheel portion G12*b* larger in diameter than the small-diameter toothed wheel portion G12*a* and supported coaxially on the rear of the small-diameter toothed wheel portion G12*a*. The motor gear G4 is engaged with the lower side of the large-diameter toothed wheel portion G12*b*.

Accordingly, when the motor M1 drives the motor gear G4 to rotate, a driving force is transmitted to the driven gear G11 through the intermediate gear G12 so that the driven gear G11 rotates integrally with the belt driving shaft 51.

A cylindrical portion PRa of the photoconductor drum PR is put on the drum driving shaft 51 so that the drum driving shaft 51 is connected to the photoconductor drum PR by a connection member not shown but provided in the cylindrical portion PRa.

Accordingly, when the drum driving shaft 51 rotates, the photoconductor drum PR rotates integrally with the drum driving shaft 51. On this occasion, the flywheel 56 rotates integrally with the drum driving shaft 51 so that rotation of the drum driving shaft 51 becomes stable and rotation of the photoconductor drum PR becomes stable.

A drum rotation shaft 51+PRa as an example of a rotation shaft of a first rotary body according to exemplary embodiment 1 and also as an example of a rotation shaft of an image retainer is composed of the drum driving shaft 51 and the cylindrical portion PRa.

(Operation of Exemplary Embodiment 1)

When a job as an example of an image forming operation is started in the image forming apparatus U having the aforementioned configuration according to exemplary embodiment 1, the motor M1 drives the drum rotation shaft 51+PRa and the belt rotation shaft 1+Rd to rotate, so that the photoconductor drum PR and the intermediate transfer belt B rotate. On this occasion, the flywheels 41 and 56 supported on the rear end portions of the rotation shafts 51+PRa and 1+Rd rotate integrally with the rotation shafts 51+PRa and 1+Rd to thereby stabilize rotation of the photoconductor drum PR and the intermediate transfer belt B. Accordingly, lowering of image quality of an image formed on the photoconductor drum PR or lowering of image quality of an image transferred onto the intermediate transfer belt B or transferred onto a recording sheet S from the intermediate transfer belt B is suppressed.

The flywheel 56 supported on the drum driving shaft 51 in exemplary embodiment 1 is fixed to a wheel support plate 13 of the holder 52 by the fixing screws 44' so that the flywheel 56 rotates integrally with the holder 52. A fixation cylinder 12 of the holder 52 is fastened and fixed to the drum driving shaft 51 by the clamp screws 31' and 32' so that the holder 52 rotates integrally with the drum driving shaft 51.

Figure 13:
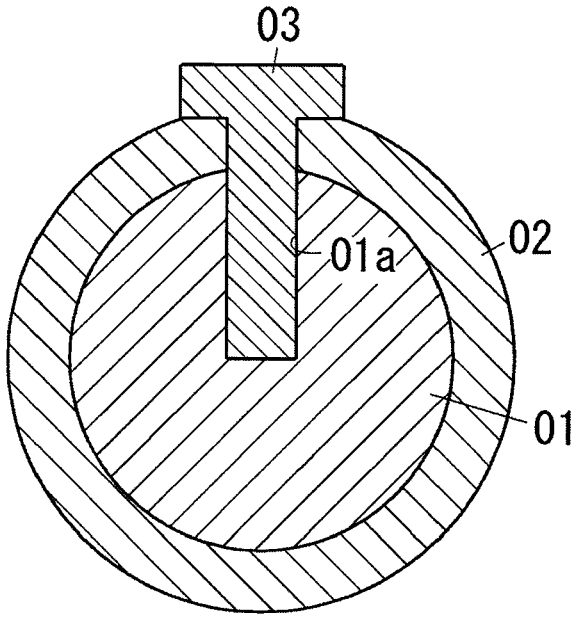
FIG. 13 is an explanatory view of an example of a method for fixing a fixation cylinder on a driving shaft according to the background art.

FIG. 13 is an explanatory view of an example of a method for fixing a fixation cylinder to a driving shaft according to the background art.

In FIG. 13, a screw hole 01*a* having a thread groove but formed radially so as not to pass through a driving shaft 01 is formed in the driving shaft 01, so that a fixation cylinder 02 of a holder is fastened directly to the driving shaft 01 by a screw 03. In such a configuration, when the shaft fixation cylinder 02 rotates relative to the driving shaft 01 during rotation, a load may be apt to be concentrated in the screw 03 to thereby cause breakage of the screw.

On the contrary, in exemplary embodiment 1, while the clamp screws 31' and 32' pass through the screw pass-through holes 3' and 4' of the drum driving shaft 51 without contact with the inner walls of the screw pass-through holes 3' and 4', the fixation cylinder 12 is fastened to the drum driving shaft 51 by the clamp screws 31' and 32'. The holder 52 rotates integrally with the drum driving shaft 51 based on a friction force between the fixation cylinder 12 and the drum driving shaft 51. Accordingly, in exemplary embodiment 1, a load imposed on the clamp screws 31' and 32' is reduced and hence a possibility of screw breakage is reduced, in comparison with the configuration where the fixation cylinder 12 is directly screwed to the drum driving shaft 51 as shown in FIG. 13.

In exemplary embodiment 1, as shown in FIGS. 8A to 8C and FIGS. 10A to 10F, the D cut portion 2' of the drum driving shaft 51 has a gap corresponding to the possible angle 17 with respect to the receiving hole 16*b*, and a gap corresponding to the allowable angle 36 is provided between the screw 31' or 32' and the screw pass-through hole 3' or 4'. In exemplary embodiment 1, the allowable angle 36 is formed to be larger than the possible angle 17 so that a clearance between the clamp screw 31' or 32' and the screw pass-through hole 3' or 4' is formed to be larger than a clearance between the D cut portion 2' and the receiving hole 16*b*.

Accordingly, even if the drum driving shaft 51 and the holder 52 may rotate relative to each other, the relative rotation of the drum driving shaft 51 and the holder 52 may be regulated because the D cut portion 2' and the receiving hole 16*b* come into contact with each other before the clamp screws 3' and 4' come into contact with the inner surfaces of the screw pass-through holes 3' and 4'.

Accordingly, even if the holder 52 fastened to the drum driving shaft 51 by the clamp screws 31' and 32' may rotate relative to the drum driving shaft 51, a load imposed on the clamp screws 31' and 32' hardly occurs and a possibility of screw breakage is reduced because the clamp screws 31' and 32' are always separated from the inner surfaces of the screw pass-through holes 3' and 4' in the relative rotation direction.

In the condition that a part of the D cut portion 2' of the drum driving shaft 51 protruding outward from the rear of the holder 52 is inserted into the insertion hole 42' and a curved surface portion 2*a'* of the D cut portion 2' comes into contact with the inner wall of the insertion hole 42', the flywheel 56 in exemplary embodiment 1 rotates with the drum driving shaft 51 as the rotation center.

On this occasion, when, for example, the D cut portion is so short that the D cut portion is supported only by the holder or supported on a new support shaft provided in the holder as described in Patent Document 1 and the flywheel is supported on the drum driving shaft without direct contact but through the holder etc., manufacturing errors or assembling errors for components are accumulated. Accordingly, the rotation center of the flywheel is displaced from the rotation center of the drum driving shaft because of the accumulated error. Thus, the flywheel is apt to be eccentric so that rotation is hardly stable.

On the contrary, the flywheel 56 according to exemplary embodiment 1 is supported directly on the drum driving shaft 51 so that the position of the rotation center of the flywheel 56 is determined In this manner, the flywheel 56 is hardly eccentric and apt to rotate stably, in comparison with the case where the flywheel 56 is supported indirectly on the drum driving shaft 51. That is, in exemplary embodiment 1, rotation of the flywheel 56 is stable so that rotation of the photoconductor drum PR becomes stable more easily.

In the holder 52 according to exemplary embodiment 1, slit portions 21 are formed in the fixation cylinder 12 so that the fixation cylinder 12 is deformed radially easily in comparison with the case where the slit portions 21 are not formed in the fixation cylinder 12. Particularly, in exemplary embodiment 1, one slit portion 21 is formed between every adjacent two of screw holes 18 and 19, and a partial cylinder wall portion 22 is provided in accordance with each of the screw holes 18 and 19. Accordingly, opposite ones of the partial cylinder wall portions 22 are deformed easily while the side of the wheel support plate 13 is used as the base end.

Accordingly, in exemplary embodiment 1, when the fixation cylinder 12 is tightened by the clamp screws 31' and 32', the fixation cylinder 12 is brought into tight contact with the drum driving shaft 51 easily and the contact area of the fixation cylinder 12 with the drum driving shaft 51 becomes large easily, in comparison with the case where the slit portions 21 are not formed. Thus, the fixation cylinder 12 and the drum driving shaft 51 may be fixed to each other surely.

Incidentally, the flywheel 41 of the belt driving shaft 1 is supported on the belt driving shaft 1 in the same manner as the configuration in which the flywheel 56 is supported on the drum driving shaft 51.

FIGS. 14A to 14C are explanatory views showing a method for removing the flywheels according to exemplary embodiment 1 of the invention. Specifically, FIG. 14A is an explanatory view of a state where the flywheels have been mounted, FIG. 14B is an explanatory view of a state where one of the flywheels has been removed, and FIG. 14C is an explanatory view of a state where the other flywheel is just about to be removed.

In FIGS. 14A to 14C, for removal of the flywheels 41 and 56 during maintenance or inspection, the flywheel 56 of the drum driving shaft 51 supported behind the flywheel 41 of the belt driving shaft 1 is removed first.

That is, first, the fixing screws 44' are loosened so that the flywheel 56 on the drum driving shaft 51 is moved backward from the holder 52 and removed. For removal of the flywheel 41 from the belt driving shaft 1, the fixing screws 44 are loosened and the holder 52 on the side of the photoconductor drum PR is rotated. That is, as shown in FIG. 14C, one side of the equilateral triangular shape of the wheel support plate 13 is adjusted for the side of the drum driving shaft 1, and the wheel support plate 13 is rotated so that the wheel support plate 13 does not overlap with a passage area for removal of the flywheel 41. When the flywheel 41 is then moved backward with respect to the holder 11, the flywheel 41 is pulled backward and removed without interference with the wheel support plate 13.

When the diameter of the wheel support plate is large on the assumption that the wheel support plate is shaped like a disk, the passage area for removal of the flywheel 41 from the drum driving shaft 1 always overlaps with the wheel support plate 13 of the holder 52. Accordingly, if the holder on the side of the photoconductor drum PR is not removed in advance for removal of the flywheel 41 from the belt driving shaft 1, the flywheel 41 cannot be removed so that the removing operation becomes complicated. To solve this problem, reduction in diameter of the flywheel 41 on the drum driving shaft 1 and reduction in diameter of the disk of the wheel support plate may be conceived. There is however a possibility that performance of stabilizing rotation of the flywheel 41 will be lowered when the diameter of the flywheel 41 is reduced. In addition, when the diameter of the disk of the wheel support plate is reduced, the wheel fixing holes 15 of the wheel support plate become close to the rotation center. Accordingly, there is a possibility that a load imposed on the fixing screws 44' due to torque will become large when the flywheel 56 is fixed by the fixing screws 44'.

On the contrary, in exemplary embodiment 1, the wheel support plate 13 of the holder 52 is shaped like a regular triangle as an example of a polygon. When the holder 52 is rotated while the distance between each of the wheel fixing holes 15 and the rotation center is kept, the wheel support plate 13 may retreat from the passage area for removal of the flywheel 41. Accordingly, in exemplary embodiment 1, the flywheel 41 may be removed easily without interference with the holder 52, while performance of the flywheel 41 is kept.

(Modifications)

Although the exemplary embodiment of the invention has been described above in detail, the invention is not limited to the exemplary embodiment. Various modifications may be made in the scope of the gist of the invention described in the scope of claims. Modifications (H01) to (H13) of the invention will be described as follows by way of example.

(H01) Although the exemplary embodiment has shown the configuration in which the image forming apparatus U is formed of a copying machine, the invention is not limited thereto. For example, the configuration of the invention may be applied to a printer, a FAX machine, a multifunctional machine having these functions, or the like.

(H02) Although the exemplary embodiment has shown the configuration in which the fixation cylinder 12 of the holder 11 or 52 is fastened and fixed to the driving shaft 1 or 51 by one clamp screw 31, 31', 32 or 32' in each of the four partial cylinder wall portions 22 interposed between adjacent ones of the slit portions 21, the invention is not limited thereto.

For example, configuration may be made in such a manner that the screw pass-through holes 3 to 4' and the screw holes 18 and 19 are further provided in the driving shaft 1 or 51 and the fixation cylinder 12 so that the fixation cylinder 12 is fastened and fixed to the driving shaft 1 or 51 by plural of clamp screws in each of the partial cylinder wall portions 22. In addition, configuration may be made in such a manner that the fixation cylinder 12 is divided into 2n partial cylinder wall portions 22, and fastened and fixed to the driving shaft 1 or 51 by n clamp screws. For example, the fixation cylinder 12 is divided into six partial cylinder wall portions 22 by slit portions 21 and fastened by three clamp screws. Further, configuration may be made in such a manner that the fixation cylinder 12 is fastened by one clamp screw or fastened unidirectionally by plural of clamp screws. That is, the positions and the number of clamp screws may be changed desirably in accordance with design and specification.

(H03) Although provision of the slit portions 21 in the fixation cylinder 12 is desirable in the exemplary embodiment, configuration having no slit portion 21 is also feasible.

(H04) Although the exemplary embodiment has shown the configuration in which the fixation cylinder 12 is fastened in such a manner that the clamp screws 31' and 32' are engaged with the screw holes 18*a* and 19*a* having cut thread grooves, the invention is not limited thereto. For example, configuration may be made in such a manner that each clamp member is composed of a screw and a nut so that the fixation cylinder 12 is fastened by the screws and the nuts.

(H05) Although the exemplary embodiment has shown the configuration in which the D cut portion 2 or 2' and the receiving hole 16*b* are used as an example of the regulated portion and an example of the regulating portion, the invention is not limited thereto. Configurations well known in the background art may be applied to the regulated portion and the regulating portion. For example, a shape of two notches formed, i.e. a WD cut shape or a rod shape radially passing through the driving shaft 1 or 51 and having opposite ends radially protruding and a shape fitted to the shape, i.e. a key and a key groove may be used so that relative rotation of the driving shaft 1 or 51 and the holder 11 or 52 may be regulated.

(H06) Although the exemplary embodiment has shown the configuration in which the flywheel 41 or 56 is disposed so as to be adjacent to the rear of the holder 11 or 52 in the rear end portion of the driving shaft 1 or 51, the invention is not limited thereto. For example, configuration may be made in such a manner that the flywheel 41 or 56 is disposed so as to be adjacent to the front of the holder 11 or 52 and the direction of the holder 11 or 52 is reversed that in exemplary embodiment 1 in terms of the front-rear direction.

(H07) Although the condition that the allowable angle 36 is larger than the possible angle 17 is desirable in the exemplary embodiment, the invention is not limited thereto. Configuration may be made in such a manner that the allowable angle 36 is smaller than the possible angle 17.

(H08) Although the configuration in which the D cut portion 2 or 2' as an example of the regulated portion is provided in the rear end portion of the driving shaft 1 or 51 is desirable in the exemplary embodiment, the D cut portion 2 or 2' may be dispensed with so that the driving shaft 1 or 51 is shaped like a column Incidentally, in this case, the receiving hole 16*b* of the holder 11 or 52 and the insertion hole 42 or 42' of the flywheel 41 or 56 are formed as columnar holes because the D cut portion 2 or 2' of the driving shaft 1 or 51 is dispensed with.

(H09) Although the exemplary embodiment has shown the configuration in which the intermediate transfer belt B as an example of an endless belt-like member is used as an example of the intermediate transferer, the invention is not limited thereto. For example, configuration using a so-called drum-type intermediate transferer may be made, and the configuration of the invention may be applied to a rotation shaft of the drum-type intermediate transferer. In addition, the rotary bodies are not limited to the image retainer such as the photoconductor drum PR and the intermediate transferer such as the intermediate transfer belt B. The configuration of the invention may be applied to any rotary body such as the registration roll Rr, the heating roll Fh of the fixing device F, the pressure roll Fp, the contact-type thickness detecting roll serving as an example of a member for detecting the thickness of a recording sheet S.

(H010) Although the exemplary embodiment has shown the case where the screw pass-through holes 3 to 4' circular in section are used as an example of the through holes provided in the rotation shafts, each hole may be formed to have any sectional shape such as a sectionally angular shape or a sectionally long hole.

(H011) Although the exemplary embodiment has shown the configuration in which the wheel support plate 13 of the holder 11 (or 52) is shaped like a regular triangle, the invention is not limited thereto. For example, the wheel support plate 13 may be formed into a so-called rotational symmetric shape such as a circle, a square, a regular pentagon, a long and narrow rectangle, etc. In addition, although the rotational symmetric shape is desirable as the shape of the wheel support plate 13, any shape may be used for the wheel support plate 13 in accordance with design and configuration.

Incidentally, as in exemplary embodiment 1, when the distance between the drum driving shaft 51 and the belt driving shaft 1 is so short that there is a possibility that the passage region for removal of one of the flywheels 41 and 56 will overlap with the wheel support plate 13 of the other flywheel, it is desirable that the wheel support plate 13 is formed into a polygon type rotational symmetric shape capable of retreating from the passage region for removal of the flywheel 41 or 56 while the distance between each of the wheel fixing holes 15 and the rotation center is kept. On the contrary, when the distance between the drum driving shaft 51 and the belt driving shaft 1 is so long that there is no possibility that the passage region for removal of one of the flywheels 41 and 56 will overlap with the wheel support plate 13 of the other flywheel, any shape may be used for the wheel support plate 13.

(H012) Although it is desirable in the exemplary embodiment that the holder 52 of the drum driving shaft 51 and the holder 11 of the belt driving shaft 1 have the same configuration, the invention is not limited thereto. For example, the detected member support portion 23 may be dispensed with in the holder 11 of the belt driving shaft 1 so that the holder 52 and the holder 11 have different configurations.

(H013) Although the exemplary embodiment has shown the configuration in which the flywheel 56 for the photoconductor drum PR is provided in the drum rotation shaft 51+PRa and the flywheel 41 for the intermediate transfer belt B is provided in the belt rotation shaft 1+Rd, the invention is not limited thereto. Configuration may be made in such a manner that the flywheel 41 or 56 is provided in only one of the driving shafts 1 and 51, for example, only the flywheel 56 is provided while the flywheel 41 is dispensed with, in accordance with specification and design of required image quality etc.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. An image forming apparatus comprising:

a rotary body which rotates in accordance with an image forming operation;

a rotation shaft of the rotary body;

a through hole which is provided in an end portion of the rotation shaft and which passes through the rotation shaft in a direction intersecting an axial direction of the rotation shaft;

a stabilizing member which is provided to rotate together with the rotary body, and which has an inserted portion into which the rotation shaft is inserted;

a holding member which is disposed so as to be adjacent to the stabilizing member in the axial direction to hold the stabilizing member on the rotation shaft, and which has a longitudinal portion having the rotation shaft inserted therein, and a support portion provided in an end portion of the longitudinal portion in the axial direction to support the stabilizing member;

a clamp member which tightens the longitudinal portion onto the rotation shaft; and a notch portion provided in the longitudinal portion to extend from a leading end portion of the longitudinal portion towards a base end portion of the longitudinal portion.

2. An image forming apparatus according to claim 1, further comprising:

a regulated portion which is provided in the end portion in the axial direction of the rotation shaft, the regulated portion formed into a non-cylindrical shape, and the regulated portion regulates relative rotation of the rotation shaft to the holding member;

a regulating portion which is provided inside the support portion, the regulating portion formed into a non-cylindrical shape into which the regulated portion is fitted, and the regulating portion comes into contact with the regulated portion to regulate relative rotation of the rotation shaft to the holding member; and a second clearance between the regulated portion and the regulating portion.

3. An image forming apparatus according to claim 1, wherein:

the rotary body is a first rotary body which is constituted by an image retainer for retaining an image on a surface of the image retainer and the holding member is a first holding member which holds a first stabilizing member for stabilizing rotation of the image retainer on a rotation shaft of the image retainer, and the image forming apparatus further comprises:

a second rotary body disposed opposite to the image retainer and constituted by an intermediate transferer onto which the image on the surface of the image retainer is transferred; and a second holding member which holds a second stabilizing member for stabilizing rotation of the intermediate transferer on an intermediate transferer rotation shaft of the intermediate transferer.

4. The image forming apparatus according to claim 1, further comprising:

a space formed in the longitudinal portion corresponding to the through hole provided in the rotation shaft, and the space passes through the longitudinal portion, wherein the longitudinal portion is formed into a cylindrical shape, wherein the clamp member passes through the space provided in the longitudinal portion and the through hole provided in the rotation shaft.

5. An image forming apparatus according to claim 4, wherein:

the through hole is a first through hole, the space is a first space, and the clamp member is a first clamp member, and the image forming apparatus further comprises:

a second through hole which is provided in an end portion of the rotation shaft and in a position displaced in the axial direction from a position at which the first through hole passes through the rotation shaft, and the second through hole passes through the rotation shaft in a direction intersecting a passing direction of the first through hole provided in the rotation shaft;

a second space which is formed in the longitudinal portion corresponding to the second through hole provided in the rotation shaft and which passes through the longitudinal portion; and a second clamp member which passes through the second space provided in the longitudinal portion and the second through hole provided in the rotation shaft.

6. An image forming apparatus according to claim 4, wherein:

the clamp member has a leading end portion which passes through the through hole provided in the rotation shaft and the space provided in the longitudinal portion; and a suppression portion which is provided in the leading end portion and which suppresses the leading end portion from moving to come off from the space provided in the longitudinal portion.

7. The image forming apparatus according to claim 1, wherein the through hole of the rotation shaft and the clamp member have a first clearance in an entire circumference of the clamp member therebetween.

8. An image forming apparatus comprising:

a rotary body which rotates in accordance with an image forming operation;

a rotation shaft of the rotary body;

a through hole which is provided in an end portion of the rotation shaft and which passes through the rotation shaft in a direction intersecting an axial direction of the rotation shaft;

a stabilizing member which is provided to rotate together with the rotary body, and which has an inserted portion into which the rotation shaft is inserted;

a holding member which is disposed so as to be adjacent to the stabilizing member in the axial direction to hold the stabilizing member on the rotation shaft, and which has a longitudinal portion having the rotation shaft inserted therein, and a support portion provided in an end portion of the longitudinal portion in the axial direction to support the stabilizing member;

a clamp member which tightens the longitudinal portion onto the rotation shaft, wherein the through hole of the rotation shaft and the clamp member have a clearance in an entire circumference of the clamp member therebetween;

a regulated portion which is provided in the end portion in the axial direction of the rotation shaft, the regulated portion formed into a non-cylindrical shape, and the regulated portion regulates relative rotation of the rotation shaft to the holding member;

a regulating portion which is provided inside the support portion, the regulating portion formed into a non-cylindrical shape into which the regulated portion is fitted, the regulating portion comes into contact with the regulated portion to regulate relative rotation of the rotation shaft to the holding member, and the regulating portion has a first gap with respect to the regulated portion in accordance with the relative rotation direction of the rotation shaft; and a second gap which is formed between the clamp member and the through hole provided in the rotation shaft, wherein a range corresponding to the second gap within which the clamp member rotates relative to the through hole provided in the rotation shaft is wider than a range corresponding to the first gap within which the rotation shaft rotates relative to the holding member.

* * * * *